US007937030B2

(12) United States Patent
Matsumoto

(10) Patent No.: US 7,937,030 B2
(45) Date of Patent: May 3, 2011

(54) DEVELOPING UNIT AND IMAGE FORMING APPARATUS

(75) Inventor: Hayato Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/470,653

(22) Filed: May 22, 2009

(65) Prior Publication Data

US 2009/0324302 A1 Dec. 31, 2009

(30) Foreign Application Priority Data

Jun. 30, 2008 (JP) ..... 2008-169833
Nov. 13, 2008 (JP) ..... 2008-290871

(51) Int. Cl.
*G03G 15/08* (2006.01)

(52) U.S. Cl. ..... 399/285; 399/55; 399/281; 399/283

(58) Field of Classification Search ..... 399/279, 399/281, 283, 285, 55, 252
See application file for complete search history.

(56) References Cited

U.S. PATENT DOCUMENTS 5,570,164 A * 10/1996 Yamamoto et al. ..... 399/283
7,221,892 B2 * 5/2007 Sato ..... 399/283
2003/0113139 A1 * 6/2003 Yasukawa et al. ..... 399/281
2008/0008504 A1 * 1/2008 Campbell et al. ..... 399/281
2009/0003889 A1 * 1/2009 Itabashi ..... 399/281
2009/0060595 A1 * 3/2009 Horiuchi ..... 399/285

FOREIGN PATENT DOCUMENTS

JP 58-223158 A * 12/1983
JP S58-223158 A 12/1983
JP H05-333674 A 12/1993
JP 08-062960 A * 3/1996
JP H08-062960 A 3/1996
JP H09-305013 A 11/1997
JP H11-167278 A 6/1999
JP 2003-005515 A 1/2003
JP 2003-084558 A 3/2003

* cited by examiner

*Primary Examiner* — Sophia S Chen
(74) *Attorney, Agent, or Firm* — Marvin A. Motsenbocker; Mots Law, PLLC

(57) ABSTRACT

An aspect of the invention provides a developing unit that includes: a developer; an image carrier on which an electrostatic latent image is formed; a first developer carrier configured to develop the electrostatic latent image formed on the image carrier by causing the developer to adhere to the electrostatic latent image; a first restriction member configured to be in press-contact with the first developer carrier; a second developer carrier configured to abut to the first developer carrier, and to form a developer layer on the second developer carrier; a second restriction member configured to abut to the second developer carrier; and a supplying member configured to supply the second developer carrier with the developer.

18 Claims, 17 Drawing Sheets

FIG. 15

| DEVELOPING UNITS | SHEET FOG | | | SMEAR | | |
|---|---|---|---|---|---|---|
| | LL ENVIRONMENT | RT ENVIRONMENT | HH ENVIRONMENT | LL ENVIRONMENT | RT ENVIRONMENT | HH ENVIRONMENT |
| FIRST EMBODIMENT | EXCELLENT | EXCELLENT | EXCELLENT | EXCELLENT | EXCELLENT | EXCELLENT |
| COMPARATIVE EXAMPLE 1 | EXCELLENT | GOOD | POOR | POOR | EXCELLENT | EXCELLENT |
| COMPARATIVE EXAMPLE 2 | EXCELLENT | EXCELLENT | EXCELLENT | POOR | POOR | EXCELLENT |

FIG. 16

| DEVELOPING UNIT | SHEET FOG | | | SMEAR | | | AFTERIMAGE | | |
|---|---|---|---|---|---|---|---|---|---|
| | LL ENVIRONMENT | RT ENVIRONMENT | HH ENVIRONMENT | LL ENVIRONMENT | RT ENVIRONMENT | HH ENVIRONMENT | LL ENVIRONMENT | RT ENVIRONMENT | HH ENVIRONMENT |
| THIRD EMBODIMENT | EXCELLENT | EXCELLENT | EXCELLENT | EXCELLENT | EXCELLENT | EXCELLENT | EXCELLENT | EXCELLENT | EXCELLENT |
| COMPARATIVE EXAMPLE 4 | EXCELLENT | GOOD | VERY POOR | VERY POOR | EXCELLENT | EXCELLENT | VERY POOR | EXCELLENT | EXCELLENT |
| COMPARATIVE EXAMPLE 5 | EXCELLENT | EXCELLENT | EXCELLENT | VERY POOR | VERY POOR | EXCELLENT | VERY POOR | EXCELLENT | EXCELLENT |

FIG. 17

| DEVELOPING UNIT | OPC FILMING | | |
|---|---|---|---|
| | LL ENVIRONMENT | RT ENVIRONMENT | HH ENVIRONMENT |
| FORTH EMBODIMENT | GOOD | EXCELLENT | EXCELLENT |
| COMPARATIVE EXAMPLE 6 | VERY POOR | POOR | EXCELLENT |

DEVELOPING UNIT AND IMAGE FORMING APPARATUS

CROSS REFERENCE TO RELATED APPLICATIONS

This application claims priority based on 35 USC 119 from prior Japanese Patent Application No. P2008-169833 filed on Jun. 30, 2008, entitled "Developing Unit and Image Forming Apparatus", and prior Japanese Patent Application No. P2008-290871 filed on Nov. 13, 2008, entitled "Developing Unit and Image Forming Apparatus", the entire contents of which are incorporated herein by reference.

BACKGROUND OF THE INVENTION

1. Field of the Invention

The invention relates to a developing unit used for an image forming apparatus such as a printer, a facsimile machine and a copying machine using an electro-photographic process.

2. Description of Related Art

In general, an image forming apparatus such as a printer using an electro-photographic process includes a developing unit configured to develop images by carrying toners as developers to photosensitive drums as electrostatic latent image carriers. The developing unit includes: toner conveying rollers for conveying toner; and developing rollers for conveying the toner, conveyed by the toner conveying rollers, to the photosensitive drum. Each of the developing rollers is in contact with the toner conveying roller on one side, and is in contact with the photosensitive drum on another side. An electrostatic latent image is formed on the photosensitive drum by exposing the photosensitive drum with light. The toner on the surface of the developing roller is attracted to the electrostatic latent image, thereby rendering the electrostatic latent image visible.

A developing blade is in press-contact with the surface of the developing roller. The developing blade is configured to triboelectrically charge toner, and concurrently to restrict the thickness of the toner layer on the developing roller. The toner is negatively charged triboelectrically by this developing blade. The surface of the photosensitive drum is initially uniformly negatively charged, and then an electrostatic latent image based on image information is formed on the surface by an LED light beam or a laser light beam. The negatively-charged toner is attracted to this electrostatic latent image area. Thereby, the image is developed.

The developing unit has the following problems. The surface of the photosensitive drum is charged unevenly to a relatively large extent. In other words, the distribution of electrostatic charge is so wide that the toner often adheres to an area beyond the electrostatic latent image area when being attracted to the photosensitive drum. This causes what is termed as "sheet fog."

To solve this problem, Japanese Patent Application Publication No. 2003-84558 discloses that a developing unit includes a developing roller, a toner conveying roller, a developing blade, a toner charging roller, a secondary toner conveying roller and a secondary developing blade. In addition, according to Japanese Patent Application Publication No. 2003-84558, the apparatus is capable of triboelectrically charging toners sufficiently enough to reach an almost saturated level, and thereby minimizing unevenness of the electrostatic charge. The patent application discloses that the apparatus is capable of reducing the likelihood that the sheet fog may occur during developing.

SUMMARY OF THE INVENTION

An aspect of the invention provides a developing unit that includes: a developer; an image carrier on which an electrostatic latent image is formed; a first developer carrier configured to develop the electrostatic latent image formed on the image carrier by causing the developer to attract to the electrostatic latent image; a first restriction member configured to be in press-contact with the first developer carrier; a second developer carrier configured to abut to the first developer carrier, and to form a developer layer on the second developer carrier; a second restriction member configured to abut to the second developer carrier; and a supplying member configured to supply the second developer carrier with the developer.

The developing unit is capable of preventing the toner from being too highly charged. Thus, the toner moves from a first developing roller to a photosensitive drum more easily. Accordingly, production of a smeared print and deterioration of the image quality can be prevented, although these may otherwise occur due to the toner attracting to a non-exposure area on the photosensitive drum. In addition, excellent image quality free from sheet fog and smear can be obtained in various operating environments.

Another aspect of the invention provides an image forming apparatus that comprises: a developing unit including a developer, an image carrier on which an electrostatic latent image is formed, a first developer carrier configured to develop the electrostatic latent image formed on the image carrier by causing the developer to attract to the electrostatic latent image, a first restriction member configured to be in press-contact with the first developer carrier, a second developer carrier configured to abut to the first developer carrier, and to form a developer layer, a second restriction member configured to abut to the second developer carrier, and a supplying member configured to supply the second developer carrier with the developer; and a power supply configured to supply voltages to the first developer carrier, the second developer carrier and the supplying member, respectively.

Still another aspect of the invention provides a developing unit, which comprises: a developer supplier configured to supply the developer; a first developer conveyer biased with a first voltage and configured to attract and convey the developer from the developer supplier; a second developer conveyer configured to attract and convey the developer from the first developer conveyer, while being biased with a second voltage having a absolute value smaller than the first voltage; and an image carrier on which is formed an electrostatic latent image by exposing the previously charged image carrier to light. The electrostatic latent image is rendered visible by attracting the developer from second developer conveyer.

BRIEF DESCRIPTION OF THE DRAWINGS

FIG. 15 shows the evaluations for sheet fog and smear of the printed samples obtained from cyan toner according to the first embodiment.

FIG. 16 shows the evaluations for sheet fog and smear of the printed samples obtained from cyan toner according to the third embodiment.

FIG. 17 shows the evaluations for the OPC filming according to the fourth embodiment.

DETAILED DESCRIPTION OF EMBODIMENTS

Figure 1:
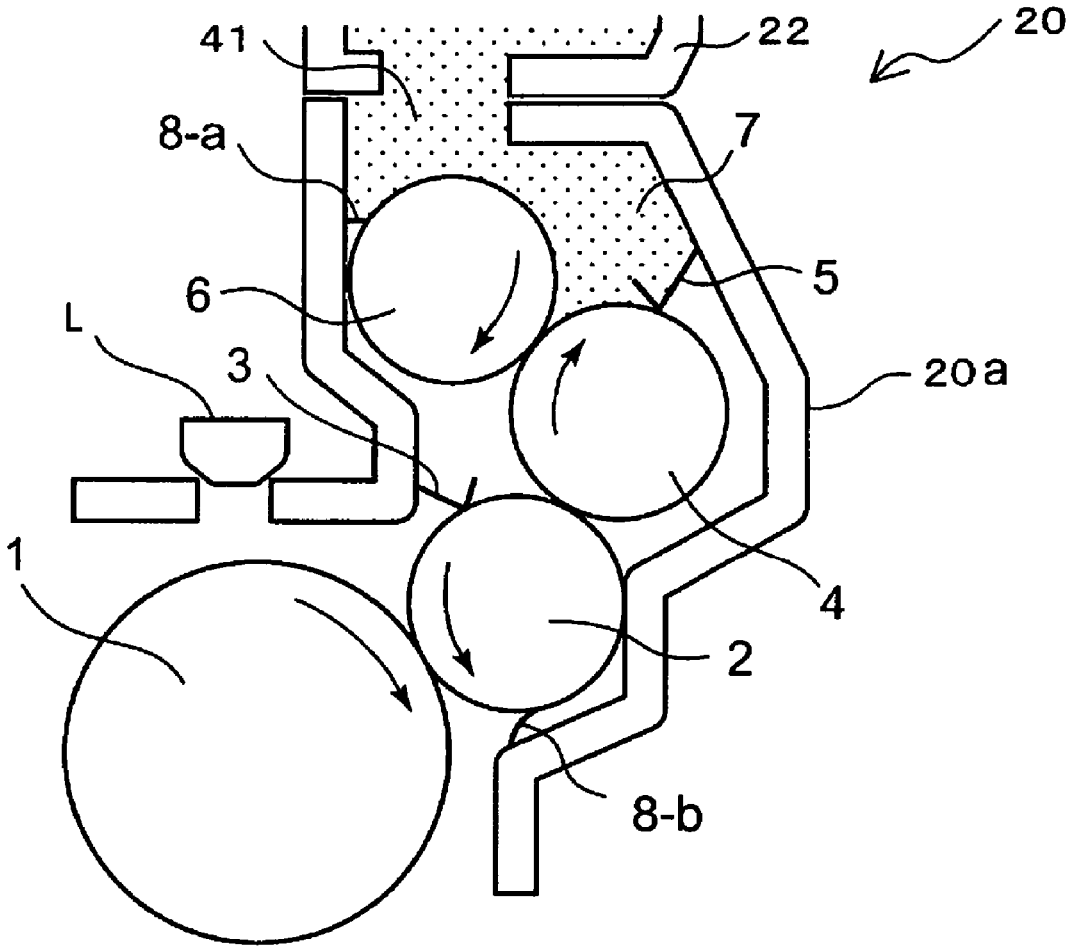
FIG. 1 is a configuration diagram of a developing unit according to a first embodiment.

Descriptions are provided hereinbelow for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

First Embodiment

Figure 2:
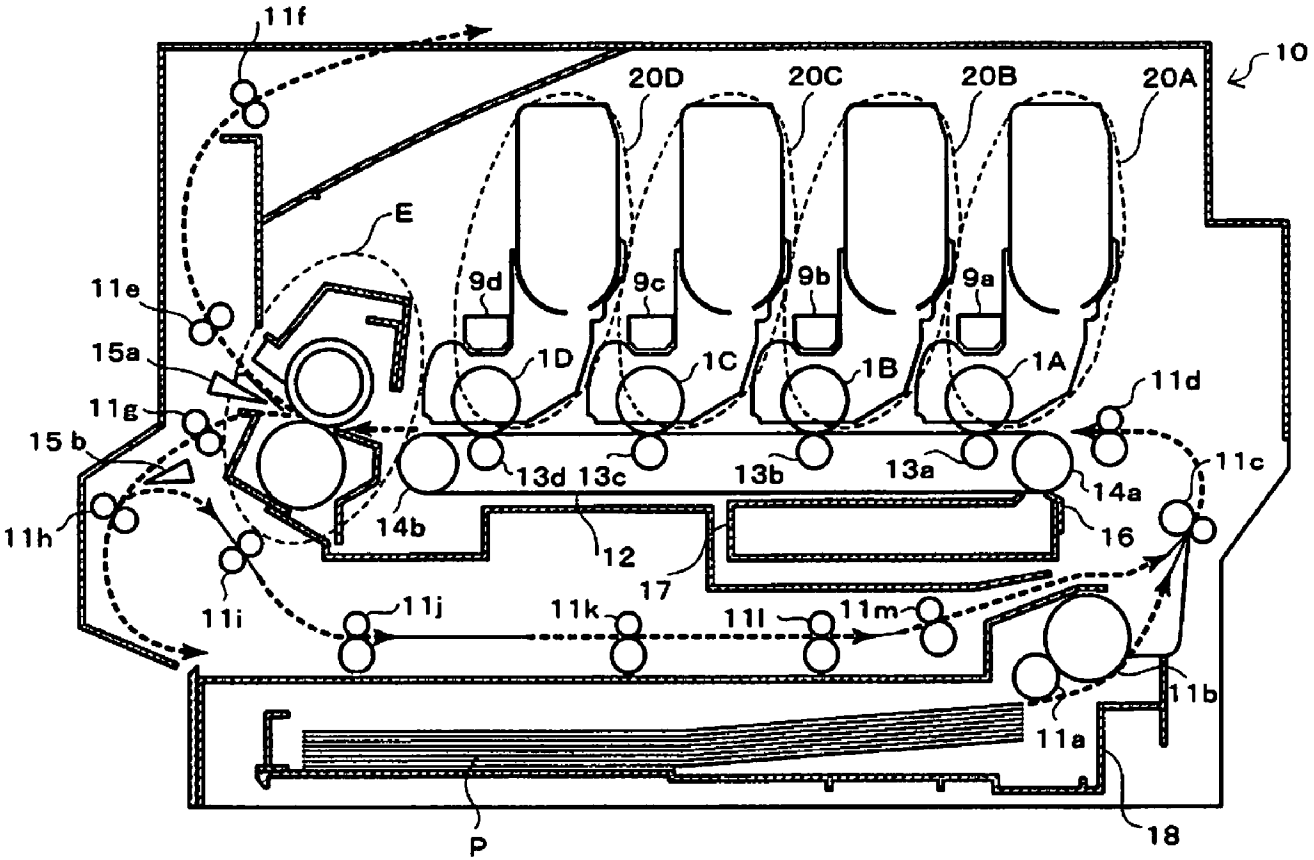
FIG. 2 is a schematic diagram of a printer including the developing unit according to the first embodiment.

Referring to the drawings, descriptions are hereinbelow provided for a first embodiment. FIG. 2 is a schematic diagram of a printer including a developing unit according to the first embodiment. As shown in FIG. 2, paper feeding cassette 18 is placed in the lowermost portion of the main body of printer 10. Paper feeding cassette 18 is configured to contain sheets P as recording media. A feeding mechanism for sheets P includes: paper feeding rollers 11*a*, 11*b*; paired conveying rollers 11*c*; and paired conveying rollers 11*d*, paired conveying rollers 11*c*, 11*d* configured to convey sheet P fed from paper feeding rollers 11*a*, 11*b*.

Reference numerals 20A, 20B, 20C, 20D denote developing units described in detail later. Developing units 20A, 20B, 20C, 20D contain black, yellow, magenta and cyan toner developer, respectively. In addition, developing units 20A, 20B, 20C, and 20D include photosensitive drums 1A, 1B, 1C, 1D, respectively. Images are developed on photosensitive drums 1A, 1B, 1C, 1D with their respective toners.

Transfer belt 12 functions as a conveyer member of sheet P, and concurrently as a transfer member to be described later. Transfer belt 12 is driven by a belt motor (not illustrated) which is a driver configured to convey transfer belt 12. Transfer belt 12 is stretched between drive roller 14*b* and belt idle roller 14*a*. Printer 10 further includes transfer rollers 13*a*, 13*b*, and 13*c*, 13*d*. Transfer rollers 13*a*, 13*b*, 13*c*, 13*d* are placed facing photosensitive drums 1A, 1B, 1C, 1D with transfer belt 12 being interposed in between. The transfer unit comprises transfer belt 12 and transfer rollers 13*a*, 13*b*, 13*c*, 13*d*.

Toner images formed on photosensitive drums 1 are transferred onto sheet P by respective developing units 20 and the transfer unit. Thereby, black, yellow, magenta and cyan images are formed on sheet P.

Reference letter E denotes a fuser configured to fuse the color toner images on sheet P. Printer 10 further includes paired conveying rollers 11*e* and paired discharging/conveying rollers 11*f* which are configured to discharge sheet P out of the apparatus main body after the color toner images are fused on sheet P.

Reference numerals 11*g* to 11*m* denote conveying rollers. Reference numerals 15*a*, 15*b* denote movable recording sheet travelling guides. These constitute a duplex printing unit. Use of the duplex printing unit makes it possible to form an image on the front surface of sheet P, and subsequently to form another image on the back surface of the same sheet P after reversing sheet P. Reference numeral 16 denotes a transfer belt cleaning blade, and reference numeral 17 denotes a waste developer tank included in the transfer unit.

FIG. 1 is a configuration diagram common among developing units 20 according to the first embodiment. Reference numeral 1 denotes the photosensitive drum as an image carrier. Previously charged photosensitive drum 1 is exposed to an led light beam or a laser light beam as light source L according to image information, thereby forming an electrostatic latent image on photosensitive drum 1. Subsequently, the electrostatic latent image on photosensitive drum 1, is developed with the toner. Thereby, a visible image is formed on the surface of photosensitive drum 1. Photosensitive drum 1 is supported so as to rotate at a predetermined speed in a direction indicated by a corresponding arrow. Note that photosensitive drum 1 is charged evenly by a charger (not illustrated), and subsequently exposed to the light from light source L. Thereby, the electrostatic latent image is formed on the surface of photosensitive drum 1.

Reference numeral 2 denotes first developing roller as a developer carrier. First developing roller 2 is configured to abut to photosensitive drum 1 and to cause the toner to attract to the electrostatic latent image formed on photosensitive drum 1. First developing roller 2 rotates together with photosensitive drum 1, and is moveably supported so as to rotate in the same direction as photosensitive drum 1, as shown by a corresponding arrow. First developing roller 2 is made of a conducting member to which a predetermined voltage is applied. First developing roller 2 is located so as to be separated from toner 7 supplied through supplying port 41 to be described later. In addition, first developing roller 2 is located facing second developing roller 4 to be described later. Thus, first developing roller 2 receives toner 7 from second developing roller 4, and conveys the toner to photosensitive drum 1.

Reference numeral 3 denotes first developing blade as a restriction member configured to restrict the thickness of a layer of the toner formed on first developing roller 2. A first end of first developing blade 3 is in press-contact with first developing roller 2, and a second end of first developing blade 3 is fixed to the inside of case wall 20*a* forming developing unit 20. The second end of first developing blade 3 is located to bring the first end into press-contact with first developing roller 2 at a position upstream of a contact position (facing position) between first developing roller 2 and photosensitive drum 1 in a rotational direction of first developing roller 2. Consequently, first developing blade 3 is located between the contact position (facing position) of first developing roller 2 and photosensitive drum 1, and a contact position (facing position) of first developing roller 2 and second developing roller 4, to be described later, and more specifically is located upstream of the latter contact position in the rotational direction of first developing roller 2. Furthermore, first developing blade 3 is biased with a predetermined polarity (positive or negative) voltage.

Reference numeral 4 denotes second developing roller as another developer carrier. Second developer roller 4 is configured to abut to first developing roller 2 for forming a layer of the developer. Second developing roller 4 rotates together with first developing roller 2, and is moveably supported so as to rotate in a direction as shown by a corresponding arrow. Second developing roller 4 abuts to first developing roller 2 at an abutment position (a first abutment point) located upstream of the press-contact position between first developing roller 2 and first developing blade 3 in the rotational direction of first developing roller 2. Second developing roller 4 contacts with toner 7 supplied through supplying port 41 (described later) at an area between an abutment position with toner supplying roller 6 (described later) and a press-contact position with second developing blade 5 described below. Thus, second developing roller 4 conveys toner 7 supplied through toner supplying roller 6 and supplying port 41.

Reference numeral 5 denotes second developing blade as another restriction member, which is configured to restrict the thickness of a layer of the toner formed on second developing roller 4. A first end of second developing blade 5 is configured to be in press-contact with second developing roller 4, and a second end of second developing blade 5 is fixed to the inside of case wall 20*a* forming developing unit 20. The second end of second developing blade 5 is located so that the first end of second developing blade 5 is in press-contact with second developing roller 4 at position located upstream of a contact position (facing position) between second developing roller 4 and first developing roller 2, and upstream of a contact position (facing position) between second developing roller 4 and toner supplying roller 6 described later, in the rotational direction of second developing roller 4. Furthermore, second developing blade 5 is biased with a predetermined polarity (positive or negative) voltage.

Reference numeral 6 denotes a toner supplying roller as a developer supplying member. Toner supplying roller 6 is configured to abut to second developing roller 4, and to supply second developing roller 4 with toner 7 through supplying port 41. Toner supply roller 6 faces second developing roller 4, and is moveably supported so as to rotate in a direction opposite to the rotational direction of second developing roller 4 as shown by a corresponding arrow. Toner supplying roller 6 abuts to second developing roller 4 at an abutment position (second abutment point) located upstream of the press-contact position between second developing blade 5 and second developing roller 4 in the rotational direction of second developing roller 4.

Reference numerals 8-*a*, 8-*b* denote sealing members configured to prevent toner 7 from leaking out of developing unit 20. Developing unit 20 has supplying port 41 in its uppermost portion. The toner is supplied to the inside of developing unit 20 through supplying port 41. Toner container 22 is detachably attached to developing unit 20. Toner container 22 constitutes a developer container configured to contain the toner.

First developing roller 2 and second developing roller 4 are made of the same material and shape. First and second developing rollers 2, 4 each include: a steel core whose surface is plated with nickel; an elastic layer made of urethane rubber formed around the cored bar; and a surface layer made of isocyanate formed on the surface of the elastic layer.

In addition, first developing blade 3 and second developing blade 5 are made of the same material into the same shape. 0.08-mm-thick stainless steel (SUS304B-TA) plates folded with a radius of 0.275 mm are used as first and second developing blades 3, 5. The stainless steel plates thus folded are respectively in press-contact with first and second developing rollers 2, 4 as follows. A short folded side of each stainless steel plate is faced upstream in a rotational direction of its corresponding developing roller being in press-contact with the stainless steel plate, whereas a long folded side of the stainless steel plate is faced downstream in the rotational direction thereof. In addition, the stainless steel plates bend with the same linear pressure (approximately 40 gf/cm to 70 gf/cm).

Toner supplying roller 6 is a sponge-like roller, which has a silicone foamed rubber around its cored bar. The silicone foamed rubber includes open cells each with a diameter of 300 μm to 500 μm. In this embodiment, toner 7 is ground powder of a single non-magnetic component with an average particle diameter of 5.5 μm and negatively charged. In addition, although not illustrated in FIG. 1, a power supply (whose details are described later) applies DC voltages of −150 V, −200 V and −300 V to first developing roller 2, second developing roller 4 and toner supplying roller 6, respectively, during a printing operation.

Descriptions are now provided for how printer 10 according to the first embodiment operates. Once printer 10 shown in FIG. 2 receives a print instruction from a printer controller (not illustrated), development units 20 start their respective developing processes described below. Meanwhile, one of sheets P contained in paper feeding cassette 18 is conveyed to a position just before transfer belt 12 by paper feeding rollers 11*a*, 11*b*, paired conveying rollers 11*c* and paired conveying rollers 11*d*. Once developing units 20 start their respective developing processes, the transfer unit comprised of transfer belt 12 and transfer rollers 13 transfers the respective visible images onto sheet P on transfer belt 12. Subsequently, the visible images on sheet P are fused on sheet P by fuser E. Thereafter, resultant sheet P is discharged out of printer 10 by paired conveying rollers 11*e* and paired discharging/conveying rollers 11*f*.

Next, descriptions are provided for how each developing unit 20 according to the first embodiment operates in a developing process. As shown in FIG. 1, a driver (not illustrated) causes photosensitive drum 1, first developing roller 2, second developing roller 4 and toner supplying roller 6 to rotate in their respective directions indicated by the arrows shown in FIG. 1.

First, as described above, the DC voltage of −300 V is applied to toner supplying roller 6, whereas the DC voltage of −200 V is applied to second developing roller 4. At this time, toner 7 is supplied to second developing roller 4 as a developer conveyer by toner supplying roller 6. Second developing roller 4 conveys toner 7 to second developing roller 4. A toner layer as a developer layer is formed on second developing roller 4. The thickness of the layer is restricted by the interaction between second developing roller 4 and second developing blade 5. The toner layer is triboelectrically negatively charged. Immediately after second developing blade 5 restricts the layer thickness, the amount of toner included in the toner layer formed on second developing roller 4 is 0.70 mg/cm$^2$ to 0.90 mg/cm$^2$, and the amount of electrostatic charge of the toner is −20 μC/g to −35 μC/g.

As described above, a DC voltage of −150 V is applied to first developing roller 2. Second developing roller 4 and first developing roller 2 are in contact with each other. The potential of first developing roller 2 is different from the potential of second developing roller 4. For these reasons, the toner layer is released from the surface of second developing roller 4, and is attracted to the surface of first developing roller 2 as another developer conveyer. On first developing roller 2, the layer thickness of the toner layer is restricted by first developing blade 3. In addition, the toner is triboelectrically charged. Immediately after the second layer thickness restriction is completed by first developing blade 3, the amount of toner included in the toner layer formed on first developing roller 2 is 0.50 mm/cm$^2$ to 0.55 mm/cm$^2$, and the amount of electrostatic charge of the toner is −35 μC/g to −45 μC/g.

Finally, due to the difference in potential between first developing roller 2 and the photosensitive drum 1, the toner layer conveyed by first developing roller 2 is attracted to a latent image formed on photosensitive drum 1. Thereby, the latent image is developed with the toner. Here, photosensitive drum 1 is charged such that a portion of the electrostatic latent image is charged to approximately 0 V, whereas a portion other than the electrostatic latent image is charged to, for example, −500 V to −700 V. Note that toner supplying roller 6, sealing member 8-*a* abutting to toner supplying roller 6, second developing roller 4 and second developing blade 5 restrict toner 7 supplied through supporting port 41 from moving to first developing roller 2. Furthermore, as described above, first developing roller 2 is located away from toner 7 supplied through supplying port 41. Consequently, toner 7 adhering to first developing roller 2 is just toner 7 charged and conveyed by second developing roller 4.

Next, descriptions are provided for a result of evaluation of "sheet fog" and "smear" for the first embodiment and comparative examples 1 and 2 To begin with, descriptions are provided for schematic configurations of comparative examples 1 and 2. Note that comparative examples 1 and 2 commonly use the toner and printer described with regard to the first embodiment.

Figure 3:
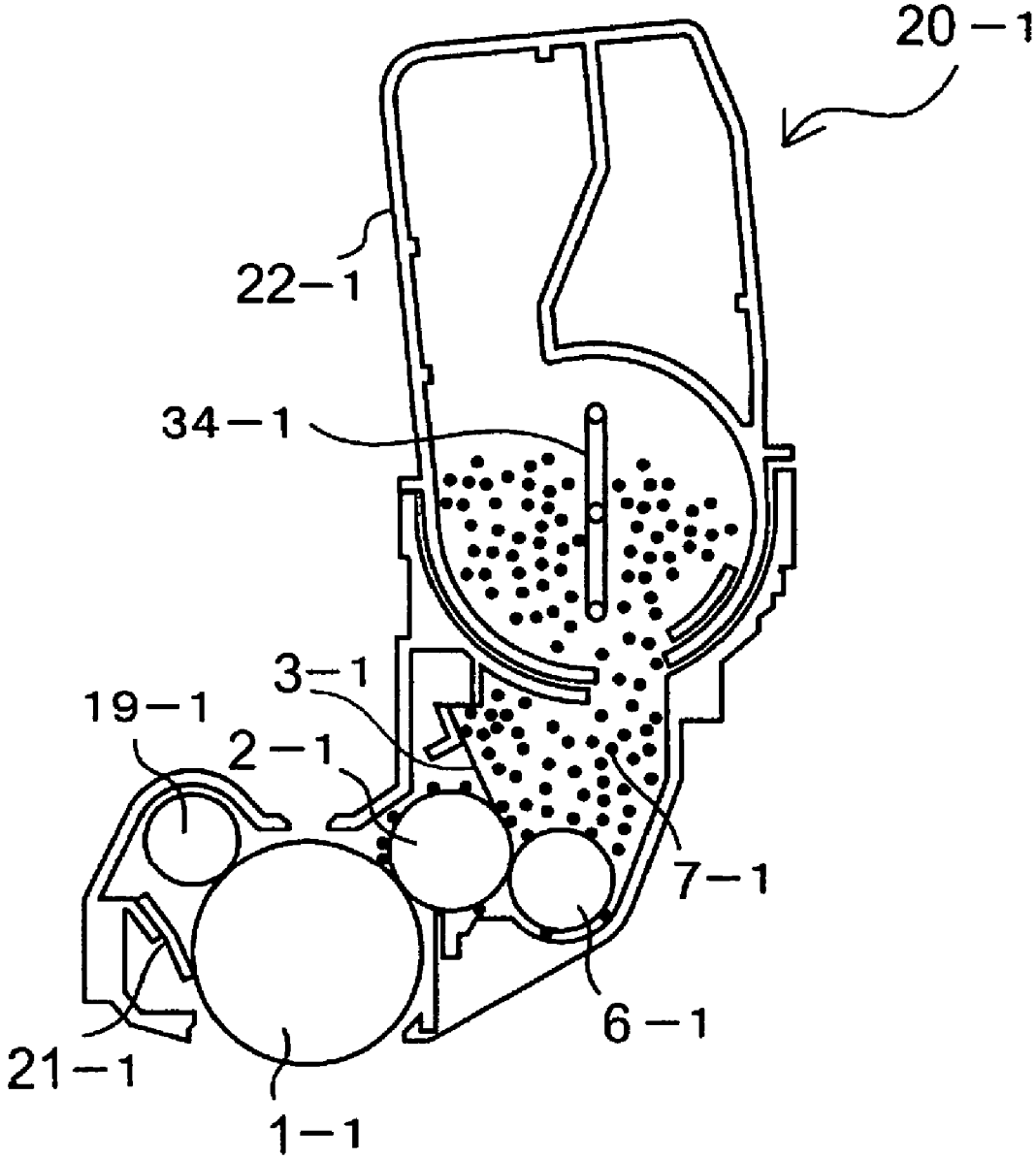
PRIOR ART FIG. 3
FIG. 3 is a side cross-sectional view showing a schematic configuration of a developing unit according to comparative example 1.

FIG. 3 is a side cross-sectional view showing a schematic configuration of developing unit 20-1 according to comparative example 1. Developing unit 20-1 includes: photosensitive drum 1-1; charging roller 19-1 provided at periphery of and in contact with photosensitive drum 1-1, and including a metal shaft coated with a semiconductive epichlorohydrin rubber; developing roller 2-1; developing blade 3-1; toner supplying roller 6-1; agitating bar 34-1 configured to agitate toner 7-1 in developing unit 20-1; and cleaning blade 21-1 as a toner collecting unit configured to collect a residual portion of the toner which remains on photosensitive drum 1-1 after the rest of the toner is transferred onto sheet P, cleaning blade 21-1 being made of urethane rubber. In addition, during a print operation, a power supply (not illustrated) applies DC voltages of −200 V and −300 V to developing roller 2-1 and toner supplying roller 6-1, respectively. Furthermore, a supplying port through which toner 7-1 is supplied to the inside of developing unit 20-1 is included in the uppermost portion of developing unit 20-1. Toner container 22-1 configured to contain toner 7-1 is detachably attached to developing unit 20-1.

Figure 4:
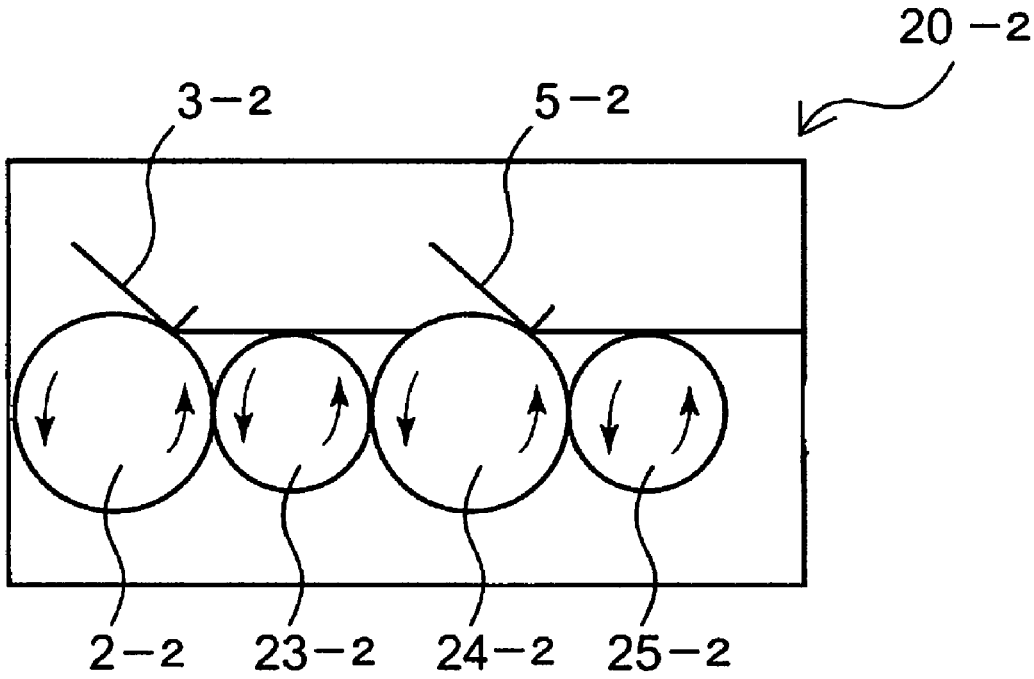
PRIOR ART FIG. 4
FIG. 4 is a side cross-sectional view showing a schematic configuration of a developing unit according to comparative example 2.

FIG. 4 is a side cross-sectional view showing a schematic configuration of developing unit 20-2 according to comparative example 2. A configuration according to comparative example 2 is based on a configuration shown in Japanese Patent Application Publication No. 2003-84558. Developing unit 20-2 according to comparative example 2 includes: developing roller 2-2, toner conveying roller 23-2, developing blade 3-2, toner charging roller 24-2, secondary toner conveying roller 25-2 and secondary developing blade 5-2. Toner conveying roller 23-2 and secondary toner conveying roller 25-2 are electrically-conductive rollers made of a similar material. The material is obtained by dispersing an electrically conductive filler (such as electrically conductive carbon or metal powder) into urethane rubber, silicone rubber or diene rubber (such as ethylene propylene diene M-class rubber (EPDM)). In addition, toner charging roller 24-2 is made of a similar material as developing roller 2-2. Furthermore, DC voltages of approximately −150 V to −350 V and −400 V to −600 V are respectively applied to developing roller 2-2 and toner conveying roller 23-2. Moreover, DC voltages of approximately −500 V to −700 V and −550 V to −1000 V are respectively applied to toner charging roller 24-2 and secondary toner conveying roller 25-2. The developing units according to comparative examples 1 and 2 have the same members and configuration as the developing unit according to the first embodiment for those members and which are not illustrated in FIGS. 1, 3 and 4.

Figure 5:
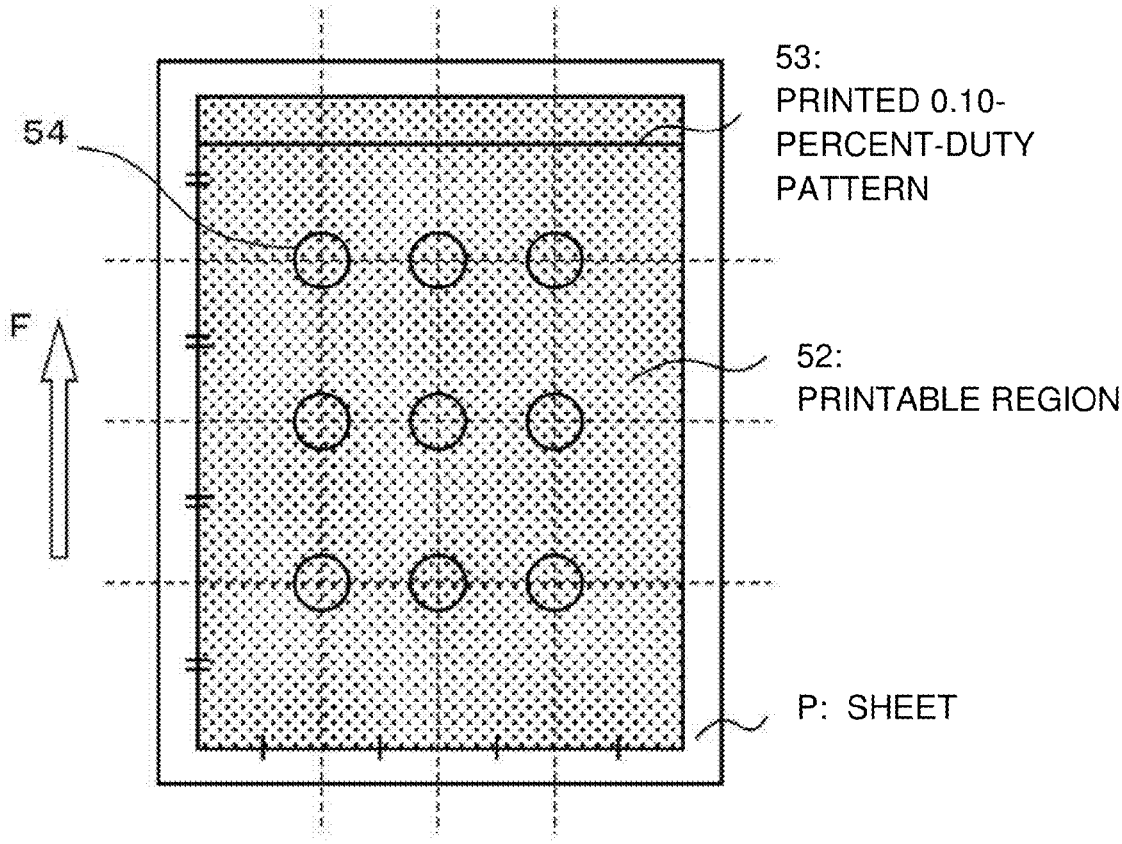
FIG. 5 is an explanatory diagram showing a method of evaluating sheet fog.

Next, descriptions are provided for an evaluation method. FIG. 5 is for illustrating the evaluation method for sheet fog. In FIG. 5, reference numeral 52 denotes a printable region on sheet P. Reference numeral 53 denotes a 0.1-percent-duty pattern printed in printable region 52. Reference numeral 54 denotes observation points in printable region 52. Arrow F indicates a direction in which sheet P is conveyed. The printing environment is a temperature of 25° C. and a humidity of 40% (hereinafter referred to as an "RT environment"). The printing speed (=photosensitive drum linear measurement=sheet passing speed) of the apparatus is set at 150 mm/sec. First, 5000 copies of a 0.3-percent-duty pattern are printed by conveying A4-size Excellent White sheets (manufactured by Oki Data Corporation) as sheets P in their lengthwise direction F. In this respect, a "100-percent-duty" means a printing condition in which 100% of an area of printable region 52 on an A4-size sheet is printed with solid image pattern. Furthermore, a "lengthwise direction" means a direction in which sheet P is conveyed with the two shorter sides of the four sides of sheet P being frontward and rearward. After the 5000 copies are printed, a copy of the above-mentioned 0.1-percent-duty pattern is printed on an A4-size standard-type sheet as sheet P, and a half-tone pattern with a print density of 25% throughout printable region 52 is printed on another sheet P.

The obtained printed samples are checked in terms of sheet fog and smear. Here, "sheet fog" means a phenomenon in which: the charge amount of toner powder is so small that the toner powder is partially charged with a polarity opposite to the polarity of normally-charged toner powder; a non-exposed area in a latent image formed on the photosensitive drum is developed with the oppositely-charged toner powder and the thus-developed non-exposed area is transferred to a sheet. This phenomenon deteriorates the quality of an image printed on a sheet.

The sheet fog is evaluated for each of the printed samples by the following method. Nine observation points 54 in the non-exposed area on the sheet on which the 0.1-percent-duty pattern is printed are magnified 500 times under a digital microscope VHX-100 (manufactured by Keyence). Here, the nine observation points are those circled on the sheet as shown in FIG. 5. For each of the nine observation points, the number of spots in which toner is observed in a 0.5 mm×0.5 mm field of view is counted through the magnified observation. Subsequently, an average of the counted numbers in the respective nine observation points is calculated. In a case where the average number of toner-observed spots is 30 or less for a printed sample, the printed sample has no toner-observed spots actually discernible, and is evaluated as having an excellent image quality. Accordingly, the result is rated as "excellent." In a case where the average number of toner-observed spots is more than 30 but not more than 60 for a printed sample, the toner-observed spots are actually indiscernible on the printed sheet. However, if the same pattern is printed in color by use of multiple developing units, the spots become visible due to slightly-colored spots which are caused by multiple color toners adhering to the spots in an overlapping manner, so the result is rated as "good." In a case where the average number of toner-observed spots is more than 60 for a printed sample, sheet fog is visible on the sheet. Accordingly, the result is rated as "poor."

In addition, "smear" is a condition in which: the thickness of a toner layer on a developing roller increases partially; thus, the partially-increased portion of the toner is developed regardless of whether an electrostatic latent image is present or absent on a photosensitive drum; hence, the partially-increased portion of the toner is transferred onto the image so as to be printed like a stripe extending in a longitudinal direction. In this evaluation, smear is evaluated by visibly checking the half-tone pattern printed throughout the sheet with a print density of 25%. In a case where no smear is observed in a printed sample, the result is rated as "excellent." In a case where a printed sample is smeared, the result is rated as "poor."

The same evaluations are conducted under two printing environments in addition to RT environment. In one environment, the temperature is 10° C. whereas the humidity is 20% (hereinafter referred to an "LL environment"). In the other environment, the temperature is 28° C. whereas the humidity is 80% (hereinafter referred to an "HH environment"). FIG. 15 shows the results of the evaluations of the printed samples obtained by use of cyan toner. However, the results of the evaluations obtained by use of each of black, yellow and magenta toners show similar tendencies. FIG. 15 shows the results of the evaluations made in terms of sheet fog and smear.

No defective print attributable to sheet fog or smear is observed in any printed sample produced by developing unit 20 according to the first embodiment under any one of the printing environments. That is because the toner is capable of being sufficiently charged, and because the excessive amount of toner more than necessary for development is restricted. This is made possible since only the toner layer restricted and charged by second developing blade 5 is configured to be once again restricted and charged by first developing blade 3.

Conversely, the printed samples produced by developing unit 20-1 according to comparative example 1 show that sheet fog tends to become progressively worse in the printing environments in which it becomes more difficult to charge the toner, that is, sheet fog gets worse in the order of the LL environment, the RT environment and the HH environment. In addition, in the printed sample produced by developing unit 20-1 under the LL environment in which it is easier to charge the toner, smear is observed due to the excessively charged toner. The printed samples produced by developing unit 20-2 according to comparative example 2 are rated as excellent in terms of sheet fog. However, the printed samples produced by developing unit 20-2 under the LL and RT environments are observed to be smeared due to the excessively charged toner.

In the descriptions for the first embodiment, the direct current (DC) is applied to both first developing roller 2 and second developing roller 4. Instead, a predetermined voltage may be applied to at least one of first developing roller 2 and second developing roller 4.

As described above, the developing unit according to the first embodiment includes: first developing roller 2 configured to cause the toner to attract to the electrostatic latent image formed on photosensitive drum 1 to develop the image; first developing blade 3 configured to be in press-contact with first developing roller 2 to restrict the thickness of the toner layer, and concurrently to charge the toner layer with the predetermined polarity; second developing roller 4 configured to abut to first developing roller 2, and to form a toner layer; second developing blade 5 configured to be in press-contact with second developing roller 4 to restrict the thickness of the toner layer, and concurrently to charge the toner layer with the predetermined polarity; toner supplying roller 6 configured to supply second developing roller 4 with the toner. Thereby, the developing unit is capable of preventing first developing roller 2 and photosensitive drum 1 from being supplied with excessive toner. Consequently, the developing unit is capable of preventing the toner from being charged too much. Accordingly, no excessive toner moves from first developing roller 2 to photosensitive drum 1, and thus a printed matter is prevented from being smeared due to adhering of the toner to a non-exposed area on photosensitive drum 1. Thus, the developing unit is capable of preventing the image quality from deteriorating. Furthermore, excellent image quality free from sheet fog and smear can be obtained from the developing unit under various environments.

Second Embodiment

Figure 6:
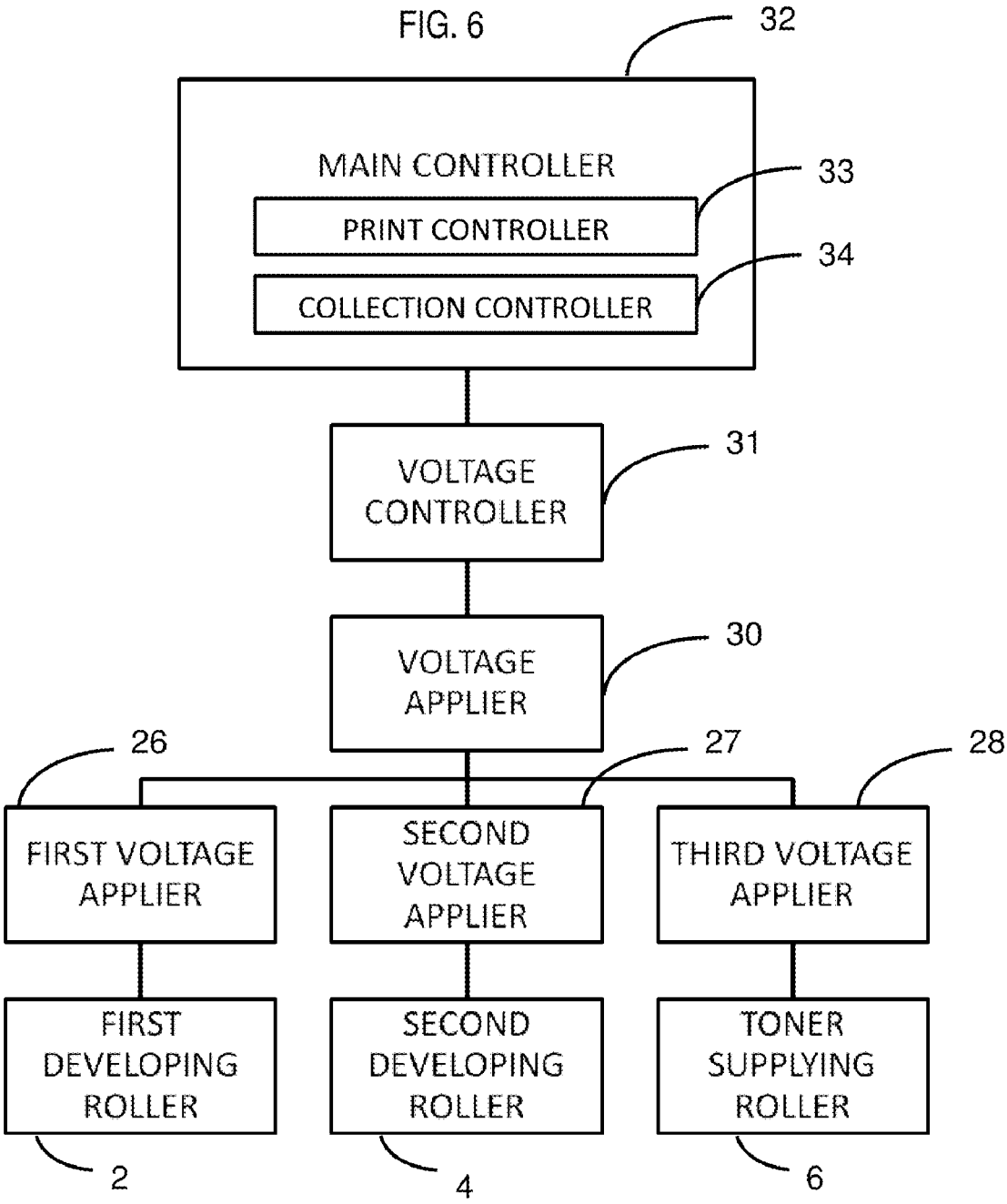
FIG. 6 is a block diagram of a controller according to a second embodiment.

Next, descriptions are provided for the second embodiment. Description of the schematic configuration of printer 10 and the configuration of each developing unit 20 according to the second embodiment are omitted since they are the same as those of the first embodiment. FIG. 6 is a block diagram of a controller according to the second embodiment, which is configured to control printer 10 shown in FIG. 2. Descriptions are provided for the configuration of FIG. 6 while corresponding to FIG. 1.

First developing roller 2, second developing roller 4 and toner supplying roller 6 are respectively connected to first voltage applier 26, second voltage applier 27 and third voltage applier 28. First voltage applier 26 supplies a first voltage to first developing roller 2. Similarly, second voltage applier 27 supplies a second voltage to second developing roller 4. In addition, third voltage applier 28 supplies a third voltage to toner supplying roller 6.

First voltage applier 26, second voltage applier 27 and third voltage applier 28 have voltage applier (power supply) 30. Furthermore, voltage applier 30 is connected to voltage controller 31. Voltage controller 31 is connected to main controller 32. Main controller 32 controls the other blocks. Moreover, main controller 32 includes: print controller 33 configured to control the operation of printer 10 during a normal printing operation; and collection controller 34 configured to control the operation of printer 10 while developing unit 20 is performing a non-printing operation, which is characteristic of the second embodiment.

Next, descriptions are provided for operations according to the second embodiment. During the normal printing operation, the operation of printer 10 controlled by print controller 33 is the same as in the first embodiment. For this reason, the descriptions according to the first embodiment are extended to the second embodiment.

Meanwhile, while each developing unit 20 is performing the non-printing operation, collection controller 34 performs control so that first, second and third voltages are respectively applied to first developing roller 2, second developing roller 4 and toner supplying roller 6. Here, the first, second and third voltages satisfy a relationship in which "the absolute value of the first voltage>the absolute value of the second voltage>the absoluter value of the third voltage." In other words, while each developing unit 20 is performing the non-printing operation, printer 10 pursues its operation by causing first voltage applier 26, second voltage applier 27 and third voltage applier 28 to be applied with the first, second and third voltages satisfying the relationship described above, and concurrently by causing drivers (not illustrated) to rotate the respective rollers. The applied voltages according to the second embodiment, for example, may be assumed to obey the following: the surface potential of a light-exposed part of photosensitive drum 1 is −50 V; and the first, second and third voltages are −300 V, −200 V and −100 V, respectively. Consequently, the relationship is defined as follows "the absolute value (50 V) of the surface potential of the light-exposed part of photosensitive drum 1<the absolute value (300 V) of the first voltage," and "the absolute value (100 V) of the third voltage>the absolute value (200 V) of the second voltage>the absolute value (300 V) of the first voltage."

Some portion of toner 7 is not developed on photosensitive drum 1 during the developing process, and remains on first developing roller 2. This portion of toner 7 is referred to as "undeveloped toner 7." While developing unit 20 is performing the non-printing operation, undeveloped toner 7 is conveyed to second developing roller 4 by the potential difference produced by collection controller 34. Thereby, no toner is left on the surface of first developing roller 2. Undeveloped toner 7 conveyed to second developing roller 4 is collected by toner supplying roller 6 using the potential difference produced by collection controller 34, and using the rotation of toner supplying roller 6, itself, in press-contact with second developing roller 4.

Once a print instruction is issued from print controller 33, voltage controller 31 controls voltage applier 30 to respectively apply the first, second and third voltages to first developing roller 2, second developing roller 4 and toner supplying roller 6. Here, the first, second and third voltages satisfy the relationship in which "the absolute value of the first voltage<the absolute voltage of the second voltage<the absolute value of the third voltage."

Figure 7:
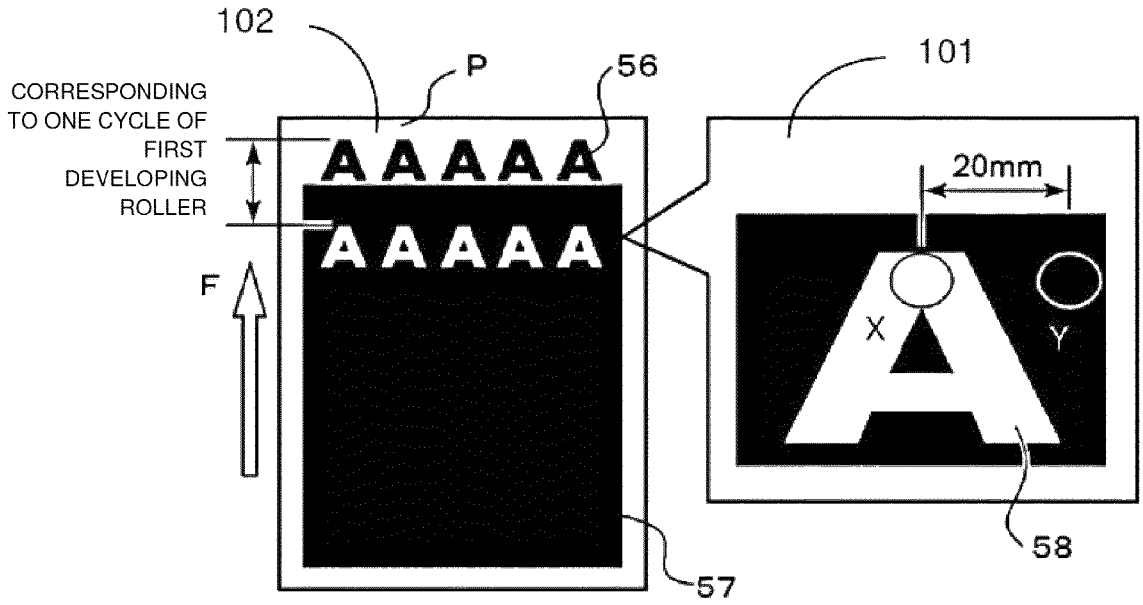
FIG. 7 is an explanatory diagram showing a method of evaluating an afterimage.

The developing unit according to the second embodiment is evaluated in comparison with comparative example 3, which is the developing unit according to the first embodiment. FIG. 7 is an explanatory diagram showing how to evaluate an afterimage. Reference numeral 101 denotes an evaluation pattern, and reference numeral 102 denotes a magnified portion extracted from an afterimage, which is described later.

First, the evaluation pattern shown with reference numeral 101 is printed in a single color. The evaluation pattern includes: multiple letters "A" as bold solid letters 56 arranged in front part of A4 size sheet P with respect to a conveying direction F (set in the longitudinal direction) of sheet P; and a solid image 57 (with a density of 100%) arranged in its subsequent portion extending to the rear end.

For the letter "A" of each solid letter 56, afterimage 58 (details are described later) appears in a printed part on sheet P after first developing roller 2 rotates one cycle. Considering this, the difference in image density between two printed portions is measured by use of an X-Rite 528. One of the two printed portions (denoted by reference letter X in magnified portion 102) is printed after one rotation of first developing roller 2 from the inside of the letter "A" and the other printed portion is located away from printed portion X by 20 mm in the horizontally right direction. The difference is measured multiple times and an average of the differences is calculated. If this average is less than 0.20, the result is rated as "excellent." If the average is equal to or more than 0.20, the result is rated as "poor."

Here, the "afterimage" means a phenomenon in which image density varies from one portion to another in a printed image due to the occurrence of a potential difference in the toner layer formed on the developing roller between a portion supplied with the toner consumed to print a front part of the sheet (in this case, the toner consumed to print the letter "A" of bold solid letter 56 in the front part), and a portion from which no toner is consumed to print the front part. As the potential difference becomes larger, the afterimage becomes more conspicuous. In addition, because afterimage 58 is due to the potential of the toner layer formed on the developing roller, afterimage 58 repeatedly appears corresponding to the circumferential pitch of the developing roller. Note that the other evaluation conditions are the same as those used to evaluate the developing units described in the first embodiment.

As a result of evaluation, the developing unit including the configuration according to the second embodiment is rated as "excellent." An excellent printed image including no afterimage (density variation) is obtained from the developing unit. That is because the configuration according to the second embodiment causes undeveloped toner 7 on second developing roller 4 to be collected, and the electric potential of the toner layer on second developing roller 4 in printing operation becomes uniform.

As described above, while performing its non-printing operation, developing unit 20 according to the second embodiment causes the first, second and third voltages to be respectively applied to first developing roller 2, second developing roller 4 and toner supplying roller 6, where the first, second and third voltages satisfy the relationship in which "the absolute value of the first voltage>the absolute value of the second voltage>the absolute voltage of the third voltage." Thereby, developing unit 20 offers an excellent image quality free from an afterimage (variation in density).

Third Embodiment

Figure 9:
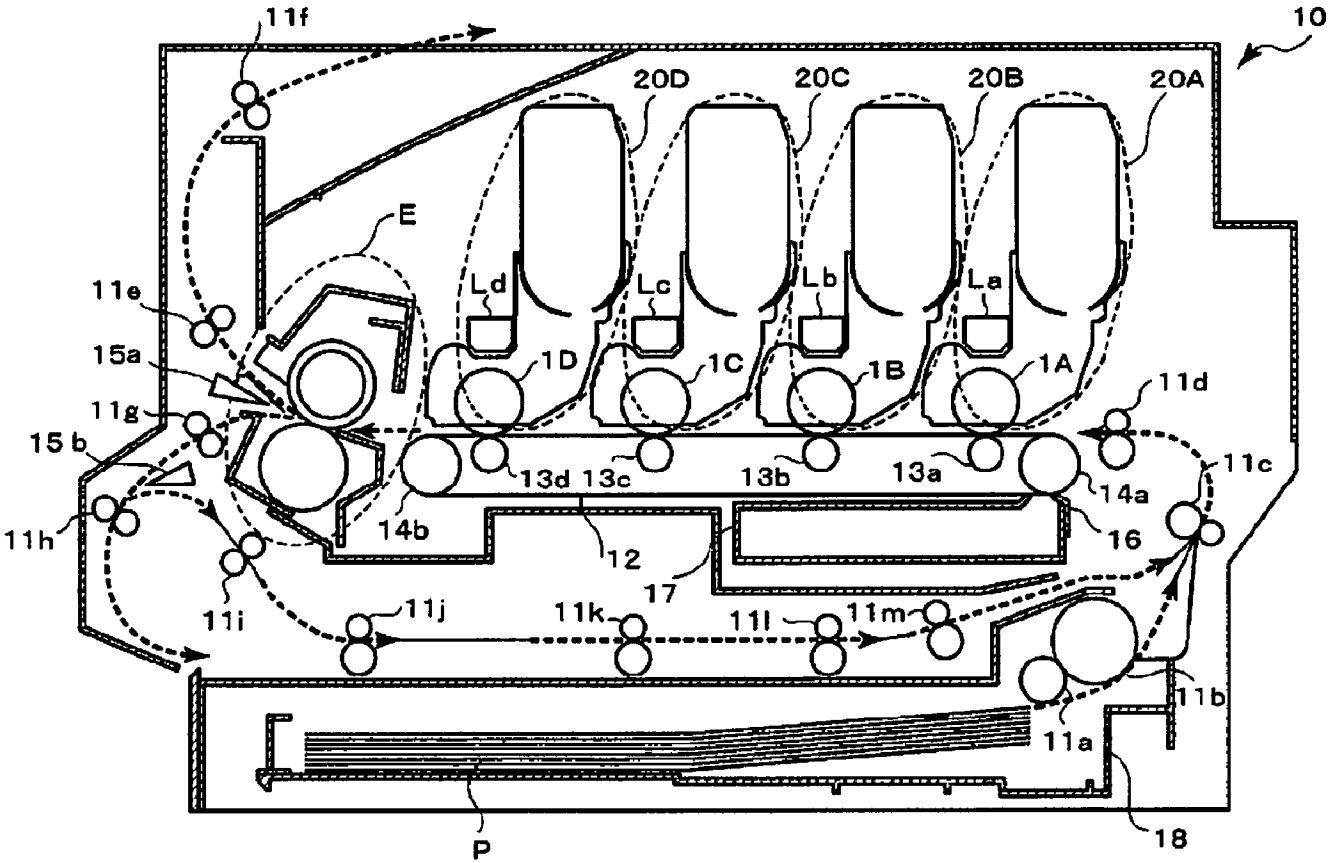
FIG. 9 is a schematic diagram of a printer including the developing unit according to the third embodiment.

Referring to the drawings, descriptions are hereinbelow provided for a third embodiment. FIG. 9 is a schematic diagram of a printer including a developing unit according to the third embodiment. As shown in FIG. 9, paper feeding cassette 18 is placed in a lowermost portion of a main body of printer 10. Paper feeding cassette 18 is configured to contain sheets P as recording media. A feeding mechanism for sheets P includes: paper feeding rollers 11*a*, 11*b*; paired conveying rollers 11*c*; and paired conveying rollers 11*d*, paired conveying rollers 11*c*, 11*d* configured to convey sheet P fed from paper feeding rollers 11*a*, 11*b*. Reference numerals 20A, 20B, 20C, 20D denote developing units described in detail later. Developing units 20A, 20B, 20C, 20D contain toners as black, yellow, magenta and cyan developers, respectively. In addition, developing units 20A, 20B, 20C, and 20D include photosensitive drums 1A, 1B, 1C, and 1D, respectively. Photosensitive drums 1A, 1B, 1C, and 1D are exposed to light by light sources La, Lb, Lc, and Ld, respectively. Thereby, electrostatic latent images are respectively formed in exposed areas on photosensitive drums 1A, 1B, 1C, and 1D. Thereafter, the electrostatic latent images are developed with the respective toners.

Transfer belt 12 functions as a conveyer member of sheet P, and concurrently as a transfer member described later. Transfer belt 12 is driven by a belt motor (not illustrated) which is a driver configured to convey transfer belt 12. Transfer belt 12 is stretched between drive roller 14*b* and belt idle roller 14*a*. Printer 10 further includes transfer rollers 13*a*, 13*b*, 13*c*, and 13*d*. Transfer rollers 13*a*, 13*b*, 13*c*, 13*d* are placed facing photosensitive drums 1A, 1B, 1C, 1D with transfer belt 12 being interposed in between, respectively. The transfer unit comprises transfer belt 12 and transfer rollers 13*a*, 13*b*, 13*c*, 13*d*. Toner images formed on photosensitive drums 1 are transferred onto sheet P by respective developing units 20 and the transfer unit. Thereby, black, yellow, magenta and cyan images are formed on sheet P.

Reference letter E denotes a fuser configured to fuse the color toner images on sheet P. Printer 10 further includes paired conveying rollers 11*e* and paired discharging/conveying rollers 11*f* which are configured to discharge sheet P out of the apparatus main body after the color toner images are fused on sheet P by fuser E. Reference numerals 11*g* to 11*m* denote conveying rollers. Reference numerals 15*a*, 15*b* denote movable recording sheet travelling guides. These comprise a duplex printing unit. Use of the duplex printing unit makes it possible to form an image on the front surface of sheet P, and subsequently to form another image on the back surface of the same sheet P after reversing sheet P. Reference numeral 16 denotes a transfer belt cleaning blade, and reference numeral 17 denotes a waste developer tank included in the transfer unit.

Figure 8:
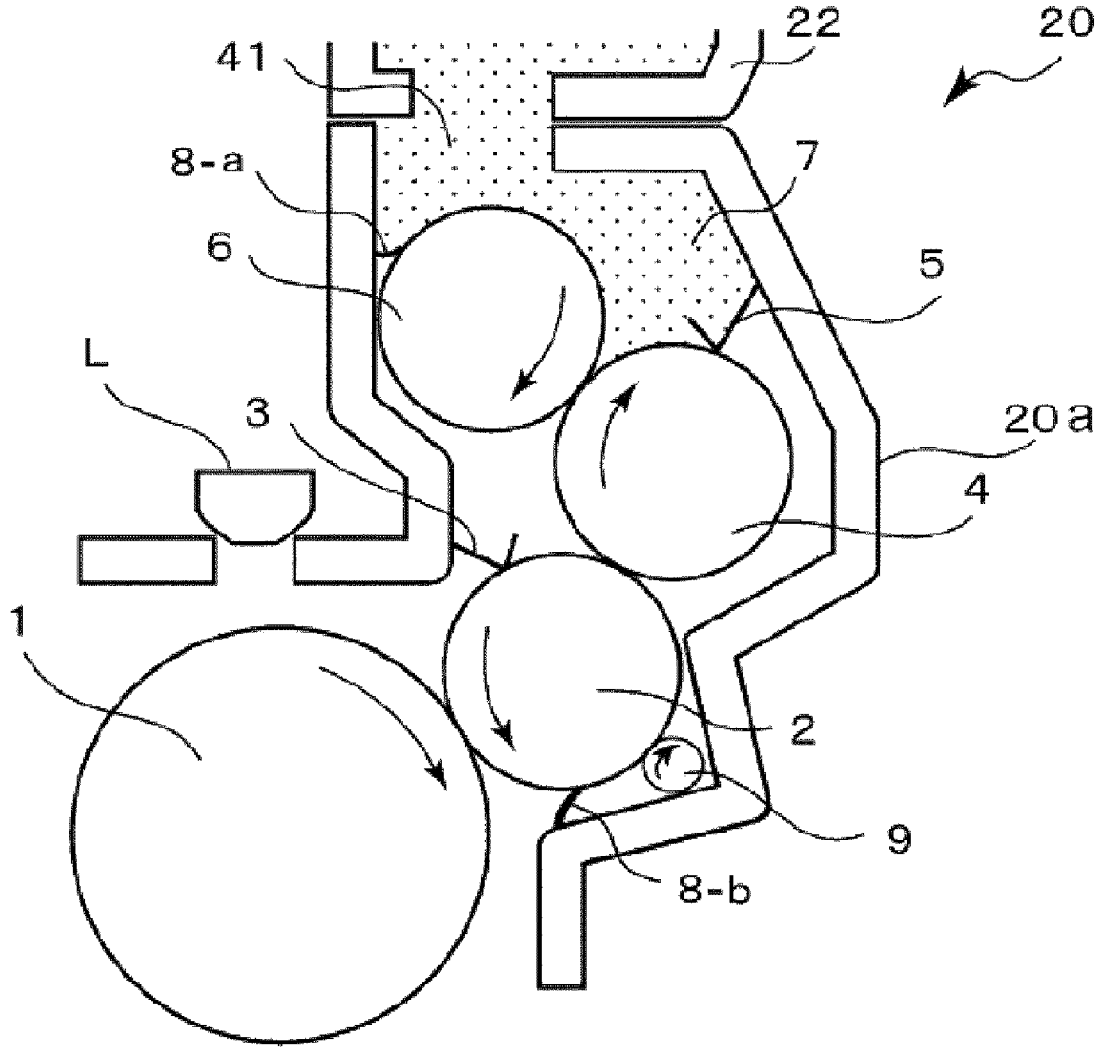
FIG. 8 is a configuration diagram of a developing unit according to a third embodiment.

FIG. 8 is a configuration diagram common among developing units 20 according to the third embodiment. Reference numeral 1 denotes the photosensitive drum as an image carrier. Previously charged photosensitive drum 1 is exposed to an LED light beam or a laser light beam from light source L image information, thereby forming an electrostatic latent image on photosensitive drum 1. Subsequently, toner 7 as a developer is attracted to the electrostatic latent image on photosensitive drum 1, and thus the image is developed with toner 7. Thereby, a visible image is formed on the surface of photosensitive drum 1. Photosensitive drum 1 is moveably supported so as to rotate at a predetermined speed in a direction indicated by a corresponding arrow. Note that photosensitive drum 1 is charged uniformly by a charger (not illustrated), and subsequently exposed to the light from light source L. Thereby, the electrostatic latent image is formed on the surface of photosensitive drum 1.

Reference numeral 2 denotes first developing roller as a first developer carrier. First developing roller 2 is configured to abut to photosensitive drum 1 and to cause the toner to be attracted to the electrostatic latent image formed on photosensitive drum 1 to develop the image. First developing roller 2 rotates together with photosensitive drum 1, and is moveably supported so as to rotate in the same direction as photosensitive drum 1, as shown by a corresponding arrow. First developing roller 2 is made of a conducting member to which a predetermined voltage is applied. First developing roller 2 is located so as to be separated away from toner 7 supplied through supplying port 41 described later. In addition, first developing roller 2 is located facing second developing roller 4 described later. Thus, first developing roller 2 receives toner 7 from second developing roller 4, and conveys toner 7 to photosensitive drum 1.

Reference numeral 3 denotes first developing blade as a restriction member, which is configured to restrict the thickness of a layer of toner 7 formed on first developing roller 2. A first end of first developing blade 3 is in press-contact with first developing roller 2, and a second end of first developing blade 3 is fixed to the inside of case wall 20*a* forming developing unit 20. The second end of first developing blade 3 is located in a way that the first end of first developing blade 3 is in press-contact with first developing roller 2 at position located upstream of a contact position (facing position) between first developing roller 2 and photosensitive drum 1 in a rotational direction of first developing roller 2. Consequently, first developing blade 3 is located between the contact position (facing position) of first developing roller 2 and photosensitive drum 1, and a contact position (facing position) of first developing roller 2 and second developing roller 4, which is described later, and more specifically is located upstream of the latter contact position in the rotational direction of first developing roller 2. Furthermore, first developing blade 3 is biased with a predetermined polarity voltage.

Reference numeral 9 is a collecting roller as a developer collecting member configured to abut to first developing roller 2, and to collect undeveloped toner 7, which is not used for development, from first developing roller 2. Collecting roller 9 is made of an electrostatic-chargeable member to which a predetermined voltage is applied, and rotates together with first developing roller 2. Collecting roller 9 abuts to first developing roller 2 at a location downstream of a contact position (facing position) between first developing roller 2 and photosensitive drum 1.

Reference numeral 4 denotes second developing roller as a second developer carrier. Second developer roller 4 is configured to abut to first developing roller 2, for forming a layer of the developer. Second developing roller 4 rotates together with first developing roller 2, and is moveably supported so as to rotate in the direction as shown by a corresponding arrow. Second developing roller 4 abuts to first developing roller 2 at an abutment position (a first abutment point) located upstream of the press-contact position between first developing roller 2 and first developing blade 3 in the rotational direction of first developing roller 2. Second developing roller 4 contacts with toner 7 supplied through supplying port 41 (described later) at an area between an abutment position with toner supplying roller 6 (described later) and a press-contact position with second developing blade 5 described below. Thus, second developing roller 4 conveys toner 7 supplied through toner supplying roller 6 and supplying port 41.

Reference numeral 5 denotes second developing blade as a second restriction member, which is configured to restrict the thickness of a layer of toner 7 formed on second developing roller 4. A first end of second developing blade 5 is in press-contact with second developing roller 4, and a second end of second developing blade 5 is fixed to the inside of case wall 20*a* forming developing unit 20. The second end of second developing blade 5 is located so that the first end is in press-contact with second developing roller 4 at a position upstream of a contact position (facing position) between second developing roller 4 and first developing roller 2, and downstream of a contact position (facing position) between second developing roller 4 and toner supplying roller 6 described later, in the rotational direction of second developing roller 4. Furthermore, second developing blade 5 is biased with a predetermined polarity voltage.

Reference numeral 6 denotes toner supplying roller as a developer supplying member. Toner supplying roller 6 is configured to abut to second developing roller 4, and to supply second developing roller 4 with toner 7 through supplying port 41. Toner supply roller 6 faces second developing roller 4, and is moveably supported so as to rotate in a direction shown by a corresponding arrow. Toner supplying roller 6 abuts to second developing roller 4 at an abutment position (second abutment point) located upstream of the press-contact position between second developing blade 5 and second developing roller 4 in the rotational direction of second developing roller 4.

Reference numerals 8-*a*, 8-*b* denote sealing members configured to prevent toner 7 from leaking out of developing unit 20. Developing unit 20 has supplying port 41 in its uppermost portion. Toner 7 is supplied to the inside of developing unit 20 through supplying port 41. Toner container 22 is detachably attached to developing unit 20. Toner container 22 constitutes a developer container configured to contain the toner.

First developing roller 2, second developing roller 4 and collecting roller 9 are made of the same material in the same shape. First and second developing rollers 2, 4 and collecting roller 9 each include: a steel-made cored bar whose surface is plated with nickel; an elastic layer made of urethane rubber formed around the cored bar; and a surface layer made of isocyanate formed on the surface of the elastic layer.

In addition, first developing blade 3 and second developing blade 5 are made of the same material in the same shape. 0.08-mm-thick stainless steel (SUS304B-TA) plates folded with a radius of 0.275 mm are used as first and second developing blades 3, 5. The stainless steel plates thus folded are respectively in press-contact with first and second developing rollers 2, 4 in the following way. A short folded side of each stainless steel plate is faced upstream in a rotational direction of its corresponding developing roller being in press-contact with the stainless steel plate, whereas a long folded side of the stainless steel plate is faced downstream in the rotational direction thereof. In addition, the stainless steel plates bend with the same linear pressure (approximately 40 gf/cm to 70 gf/cm).

Toner supplying roller 6 is a sponge roller, which has a silicone foamed rubber around its cored bar. The silicone foamed rubber includes open cells each with a diameter of 300 μm to 500 μm. In this embodiment, toner 7 is ground powder of a single non-magnetic component with an average particle diameter of 5.5 μm and negatively charged. In addition, although not illustrated in FIG. 8, a power supply (whose details are described later) applies DC voltages of −150 V, −200 V, −300 V and +100 V to first developing roller 2, second developing roller 4, toner supplying roller 6 and collecting roller 9, respectively, during a printing operation.

Descriptions are provided for how printer 10 according to the third embodiment operates. Once printer 10 shown in FIG. 9 receives a print instruction from a printer controller (not illustrated), development units 20 start their respective developing processes described below. Meanwhile, one of sheets P contained in paper feeding cassette 18 is conveyed to position just before transfer belt 12 by paper feeding rollers 11*a*, 11*b*, paired conveying rollers 11*c* and paired conveying rollers 11*d*. Once developing units 20 start their respective developing processes, the transfer unit comprised of transfer belt 12 and transfer rollers 13 transfers the respective visible images onto sheet P on transfer belt 12. Subsequently, the visible images on sheet P are fused on sheet P by fuser E. Thereafter, sheet P is discharged out of printer 10 by paired conveying rollers 11*e* and paired discharging/conveying rollers 11*f*.

Next, descriptions are provided for how each developing unit 20 according to the third embodiment operates in a developing process. As shown in FIG. 8, a driver (not illustrated) causes photosensitive drum 1, first developing roller 2, collecting roller 9, second developing roller 4 and toner supplying roller 6 to rotate in their respective directions indicated by the arrows shown in FIG. 8.

First, as described above, the DC voltage of −300 V is applied to toner supplying roller 6, whereas the DC voltage of −200 V is applied to second developing roller 4. At this time, toner 7 is supplied to second developing roller 4 as a developer conveyer by toner supplying roller 6. Second developing roller 4 conveys toner 7 to second developing roller 4. Subsequently, a toner layer as a developer layer is formed on second developing roller 4. Here, the thickness of the layer is restricted by the interaction between second developing roller 4 and second developing blade 5, and the toner layer is triboelectrically negatively charged. Immediately after second developing blade 5 restricts the layer thickness, the amount of toner included in the toner layer formed on second developing roller 4 is 0.70 mg/cm$^2$ to 0.90 mg/cm$^2$, and the amount of electrostatic charge of the toner is −20 μC/g to −35 μC/g.

As described above, a DC voltage of −150 V is applied to first developing roller 2. Second developing roller 4 and first developing roller 2 are in contact with each other. The potential of first developing roller 2 is different from the potential of second developing roller 4. Thus the toner layer is released from the surface of second developing roller 4, and is attracted to the surface of first developing roller 2 as another developer conveyer, thereby conveyed by first developing roller 2. On first developing roller 2, the layer thickness of the toner layer is restricted by first developing blade 3. In addition, the toner is triboelectrically charged. Immediately after the second layer thickness restriction is completed by first developing blade 3, the amount of toner included in the toner layer formed on first developing roller 2 is 0.50 mm/cm$^2$ to 0.55 mm/cm$^2$, and the amount of electrostatic charge of the toner is −35 μC/g to −45 μC/g.

Finally, the toner layer conveyed by first developing roller 2 is attracted to a latent image formed on photosensitive drum 1 by the difference in potential between first developing roller 2 and the photosensitive drum 1. Thereby, the latent image is developed with the toner. At this time, undeveloped toner which is not developed on photosensitive drum 1, and which accordingly remains on first developing roller 2, is conveyed to collecting roller 9 due to the difference in electric potential between first developing roller 2 and collecting roller 9.

Here, photosensitive drum 1 is charged in a way that a portion of the electrostatic latent image is charged to approximately 0 V, whereas a portion other than the electrostatical latent image is charged to, for example, −500 V to −700 V. Note that toner supplying roller 6, sealing member 8-*a* abutting to toner supplying roller 6, second developing roller 4 and second developing blade 5 restrict toner 7 supplied through supporting port 41 from moving to first developing roller 2. Furthermore, as described above, first developing roller 2 is located in such a way as to be separated away from toner 7 supplied through supplying port 41. Consequently, toner 7 adhering to first developing roller 2 is just toner 7 charged and conveyed by second developing roller 4.

Next, descriptions are provided for a result of evaluation of the third embodiment and comparative examples 1 and 2 in terms of "sheet fog" and "smear." To begin with, descriptions are provided for schematic configurations of comparative examples 1 and 2. Note that comparative examples 1, 2 commonly use the toner and printer described with regard to the third embodiment.

Figure 10:
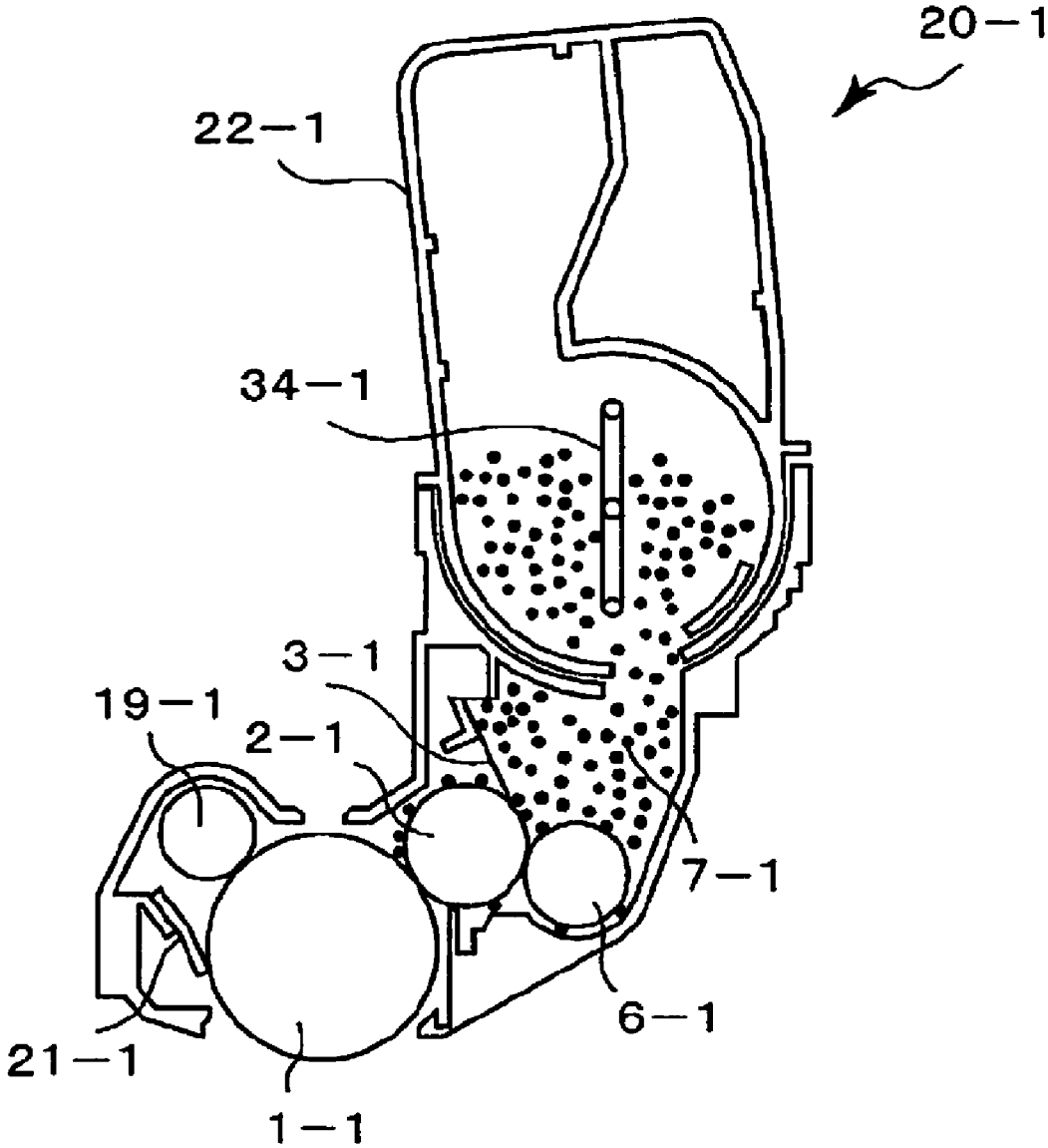
PRIOR ART FIG. 10
FIG. 10 is a side cross-sectional view showing a schematic configuration of a developing unit according to comparative example 4.

FIG. 10 is a side cross-sectional view showing a schematic configuration of developing unit 20-1 according to comparative example 4. Developing unit 20-1 includes: photosensitive drum 1-1; charging roller 19-1 provided at periphery of and in contact with photosensitive drum 1-1, and including a metal shaft coated with a semiconductive epichlorohydrin rubber; developing roller 2-1; developing blade 3-1; toner supplying roller 6-1; agitating bar 34-1 configured to agitate toner 7-1 in developing unit 20-1; and cleaning blade 21-1 as a toner collecting unit configured to collect a residual portion of toner 7-1 which remains on photosensitive drum 1-1 after the rest of the toner is transferred onto sheet P, cleaning blade 21-1 being made of urethane rubber. In addition, during a print operation, a power supply (not illustrated) applies DC voltages of −200 V and −300 V to developing roller 2-1 and toner supplying roller 6-1, respectively. Furthermore, a supplying port through which toner 7-1 is supplied to the inside of developing unit 20-1 is included in the uppermost portion of developing unit 20-1. Toner container 22-1 configured to contain toner 7-1 is detachably attached to developing unit 20-1.

Figure 11:
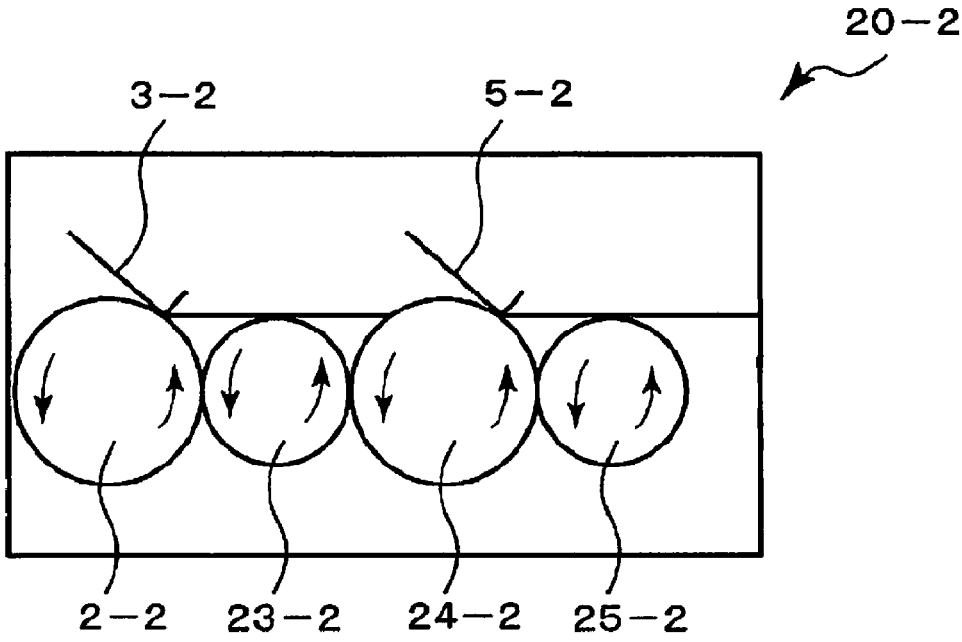
PRIOR ART FIG. 11
FIG. 11 is a side, cross-sectional view showing a schematic configuration of a developing unit according to comparative example 5.

FIG. 11 is a side cross-sectional view showing a schematic configuration of developing unit 20-2 according to comparative example 5. A configuration according to comparative example 5 is based on a configuration shown in Japanese Patent Application Publication No. 2003-84558. Developing unit 20-2 according to comparative example 5 includes: developing roller 2-2, toner conveying roller 23-2, developing blade 3-2, toner charging roller 24-2, secondary toner conveying roller 25-2 and secondary developing blade 5-2. Toner conveying roller 23-2 and secondary toner conveying roller 25-2 are electrically-conductive rollers made of a similar material. The material is obtained by dispersing an electrically conductive filler (such as electrically conductive carbon or metal powder) into urethane rubber, silicone rubber or diene rubber (such as EPDM). In addition, toner charging roller 24-2 is made of a similar material as developing roller 2-2. Furthermore, DC voltages of approximately −150 V to −350 V and −400 V to −600 V are respectively applied to developing roller 2-2 and toner conveying roller 23-2. Moreover, DC voltages of approximately −500 V to −700 V and −550 V to −1000 V are respectively applied to toner charging roller 24-2 and secondary toner conveying roller 25-2. The developing units according to comparative examples 1 and 2 have the same members and configuration as the developing unit according to the first embodiment for the members and configuration which are not illustrated in FIGS. 8, 10 and 11.

Figure 12:
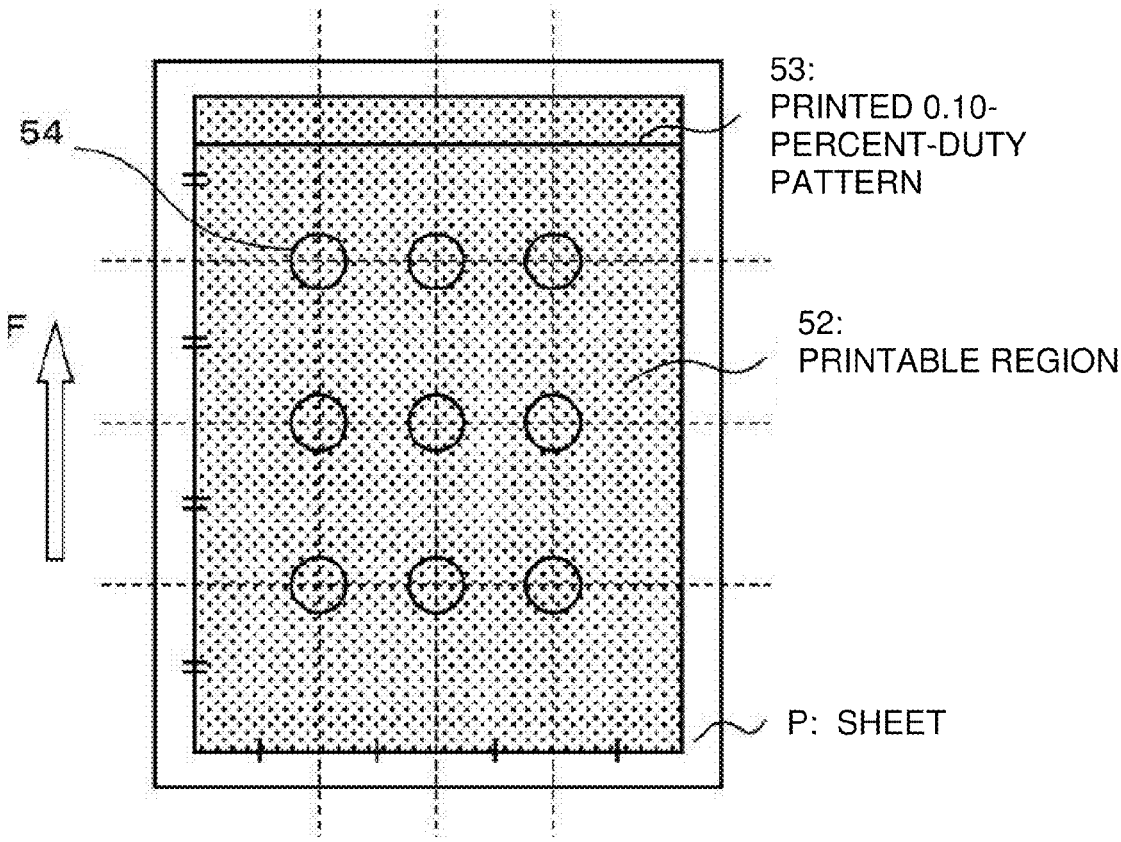
FIG. 12 is an explanatory diagram showing a method of evaluating sheet fog.

Next, descriptions are provided for an evaluation method. FIG. 12 is for illustrating the evaluation method for sheet fog. In FIG. 12, reference numeral 52 denotes a printable region on sheet P. Reference numeral 53 denotes a 0.1-percent-duty pattern printed in printable region 52. Reference numeral 54 denotes observation points in printable region 52. Arrow F indicates a direction in which sheet P is conveyed. The printing environment is a temperature of 25° C. and a humidity of 40% (hereinafter referred to as an "RT environment"). The printing speed (=photosensitive drum linear measurement=sheet passing speed) of the apparatus is set at 150 mm/sec. First, 5000 copies of a 0.3-percent-duty pattern are printed by conveying A4-size Excellent White sheets (manufactured by Oki Data Corporation) as sheets P in their lengthwise direction F. In this respect, a "100-percent-duty" means a printing condition in which 100% of an area of printable region 52 on an A4-size sheet is printed with a solid image pattern. Furthermore, a "lengthwise direction" means a direction in which sheet P is conveyed with the two shorter sides of the four sides of sheet P being frontward and rearward. After the 5000 copies are printed, a copy of the above-mentioned 0.1-percent-duty pattern is printed on an A4-size standard-type sheet as sheet P, and a half-tone pattern with a print density of 25% is printed throughout printable region 52 on another sheet P. Afterward, an evaluation pattern shown in FIG. 13 (details are described later) is printed.

The printed samples are checked in terms of sheet fog, smear and afterimage (density variation). Here, "sheet fog" means a phenomenon in which: the charge amount of toner powder is so small that the toner powder is partially charged to a polarity opposite to the polarity of normally-charged toner powder; a non-exposed area in a latent image formed on the photosensitive drum is developed with the oppositely-charged toner powder; and is transferred to a sheet. This phenomenon deteriorates the quality of an image printed on a sheet. In other words, the "sheet fog" means a phenomenon in which toner which is less charged than normally charged toner and toner which is charged with a polarity opposite to that of the normally charged toner attract to a background portion (non-image part) of the image. In this respect, the less charged toner and the oppositely-charged toner which cause the "sheet fog" are referred to as "fog toner."

The sheet fog is evaluated for each of the printed samples with the following method. Nine observation points 54 in the non-exposed area on the sheet on which the 0.1-percent-duty pattern is printed are magnified 500 times under a digital microscope VHX-100 (manufactured by Keyence). Here, the nine observation points are those circled on the sheet as shown in FIG. 12. For each of the nine observation points, the number of spots in which toner is observed in a 0.5 mm×0.5 mm field of view is counted through the magnified observation. Subsequently, an average of the counted numbers in the respective nine observation points is calculated. In a case where the average number of toner-observed spots is 30 or less for a printed sample, the printed sample has no toner spots actually discernible, and is evaluated as having an excellent image quality. Accordingly, such a printed sample is rated as "excellent." In a case where the average number of toner-observed spots is more than 30 but not more than 60 for a printed sample, the toner spots are actually indiscernible on the printed sheet. However, if the same pattern is printed in color by use of multiple developing units, the spots become visible due to slightly-colored spots which are caused by multiple color toners adhering to the spots in an overlapping manner. The result is rated as "good." In a case where the average number of toner spots is more than 60 for a printed sample, sheet fog is visible on the sheet. Accordingly, the result is rated as "poor."

In addition, "smear" is a condition in which: the thickness of a toner layer on a developing roller increases partially; thus, the partially-increased portion of the toner is developed regardless of whether an electrostatic latent image is present or absent on a photosensitive drum; hence, the partially-increased portion of the toner is transferred onto the image so as to be printed like a stripe extending in a longitudinal direction. In other words, the "smear" means a condition in which toner which is more charged than the normally charged toner (or what is termed as an excessively charged portion of toner) attracts to a background portion (or non-image part) of the image. In this respect, the excessively charged portion of toner which "smears" the image is termed as "smearing toner."

In this evaluation, smear is evaluated by visibly checking the half-tone pattern printed throughout the sheet with a print density of 25%. In a case where no smear is observed in a printed sample, the result is rated as "excellent." In a case where a printed sample is smeared, the result is rated as "poor."

The "afterimage (density variation)" means a phenomenon in which image density varies from one portion to another in a printed image due to the fact that the potential difference in a toner layer formed on the developing roller occurs between a portion supplied with new toner because the toner is consumed to print the front part, and a portion from which no toner is consumed to print the front part. As the potential difference becomes larger, the afterimage becomes more conspicuous. In addition, because the afterimage is the phenomenon dependent on the potential of a toner layer formed on the developing roller, the afterimage repeatedly appears corresponding to the circumferential pitch of the developing roller.

Figure 13:
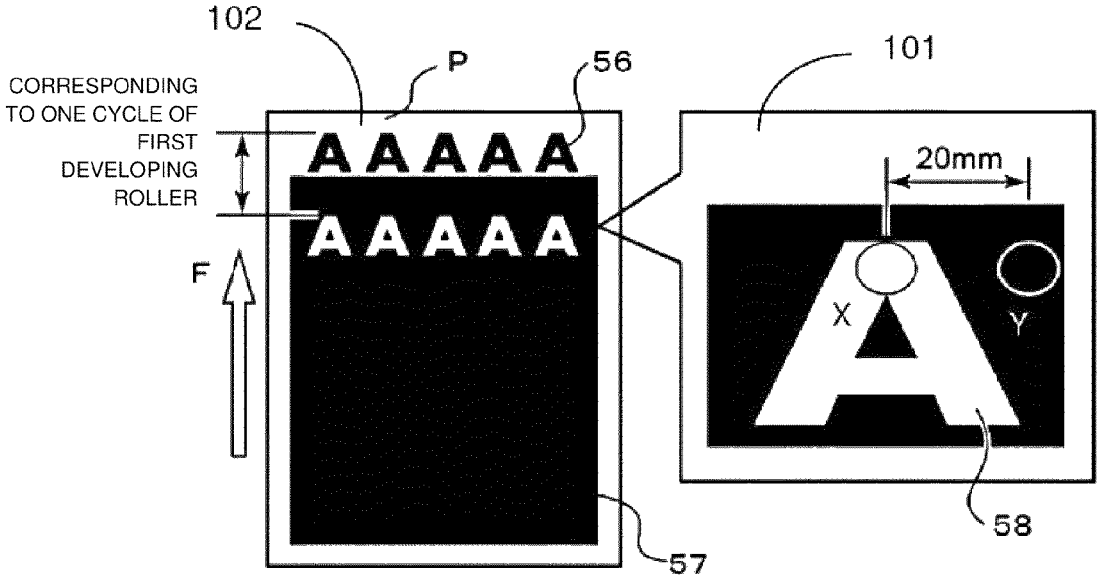
FIG. 13 is an explanatory diagram showing a method of evaluating an afterimage.

FIG. 13 is an explanatory diagram showing how to evaluate an afterimage. Reference numeral 101 denotes an evaluation pattern, and reference numeral 102 denotes a magnified portion extracted from an afterimage, which is described later. First, the evaluation pattern shown with reference numeral 101 is printed in a single color. The evaluation pattern includes: multiple letters "A" as bold solid letters 56 arranged in front part of A4 size sheet P with respect to a conveying direction F (set in the longitudinal direction) of sheet P; and a solid image 57 (with a density of 100%) arranged in its subsequent portion extending to the rear end. For the letter "A" of each solid letter 56, afterimage 58 (details are described later) appears in a printed part on sheet P after first developing roller 2 rotates one cycle. Considering this, the difference in image density between two printed portions is measured by use of an X-Rite 528. One of the two printed portions (denoted by reference letter X in magnified portion 102) is printed after one rotation of first developing roller 2 from the inside of the letter "A" and the other printed portion is located away from printed portion X by 20 mm in the horizontally right direction. The difference in image density between the two portions is measured multiple times and an average of the differences is calculated. In a case where this average is less than 0.20, the result is rated as "excellent." In a case where the average is equal to or more than 0.20, the result is rated as "poor."

The above three evaluations are conducted under two printing environment in addition to RT environment. In one environment, the temperature is 10° C. whereas the humidity is 20% (hereinafter referred to an "LL environment"). In the other environment, the temperature is 28° C. whereas the humidity is 80% (hereinafter referred to an "HH environment"). This time, the evaluations of the printed samples is obtained by use of cyan toner. However, the results of the evaluations obtained by use of each of black, yellow and magenta toners show similar tendencies. FIG. 16 shows the results of the evaluations made in terms of sheet fog and smear.

No defective print attributable to sheet fog or smear is observed in any printed sample produced by developing unit 20 according to the third embodiment under any one of the printing environments. That is because the toner is capable of being sufficiently charged, and because the excessive amount of toner more than necessary for development is restricted. This is made possible since only the toner layer restricted and charged by second developing blade 5 is configured to be once again restricted and charged by first developing blade 3. Moreover, excellent image quality is obtained for following reason. Undeveloped toner is collected by collecting roller 9, thus preventing the amount of toner on first developing roller 2 from becoming too much, and concurrently preventing the undeveloped toner from being mixed with new toner transported from second developing roller 4. Accordingly, the collection of the undeveloped toner keeps the toner layer on first developing roller 2 charged stably.

Conversely, the printed samples produced by developing unit 20-1 according to comparative example 4 show that sheet fog tends to become progressively worse in the printing environments in which it becomes more difficult to charge the toner, that is, sheet fog gets worse in the order of the LL environment, the RT environment and the HH environment. In addition, in the printed sample produced by developing unit 20-1 under the LL environment in which it is easier to charge the toner, smear and afterimage are observed due to excessively charged toner. The printed samples produced by developing unit 20-2 according to comparative example 5 are rated as "excellent" in terms of sheet fog. However, in the printed samples produced by developing unit 20-2 under the LL environment, smear and afterimage are observed due to the excessively charged toner.

In the descriptions for the third embodiment, the direct current (DC) is applied to both first developing roller 2 and second developing roller 4. Instead, a predetermined voltage may be applied to at least one of first developing roller 2 and second developing roller 4.

As described above, the developing unit according to the third embodiment includes: the first developing roller configured to cause the toner to attract to the electrostatic latent image formed on the photosensitive drum to develop the image; the first developing blade configured to be in press-contact with the first developing roller to restrict the thickness of the toner layer, and concurrently to charge the toner layer with the predetermined polarity; the collecting roller configured to abut to the first developing roller, and to collect the undeveloped toner from the first developing roller; the second developing roller configured to abut to the first developing roller, and to form a toner layer; the second developing blade configured to be in press-contact with the second developing roller to restrict the thickness of the toner layer, and concurrently to charge the toner layer with the predetermined polarity; and the toner supplying roller configured to the supply second developing roller with the toner. Thereby, the developing unit is capable of preventing first developing roller 2 and photosensitive drum 1 from being supplied with excessive toner. Consequently, the developing unit is capable of preventing the toner from being charged too much. Accordingly, no excessive toner moves from first developing roller 2 to photosensitive drum 1, and thus a printed matter is prevented from being smeared due to adhering of the toner to a non-exposed area on photosensitive drum 1. Concurrently, density in the image area, which is an area exposed to the light, is prevented from varying. Thus, the developing unit is capable of preventing the image quality from deteriorating. Furthermore, an excellent image quality free from sheet fog, smear and afterimage can be obtained from the developing unit under various environments.

Fourth Embodiment

Figure 14:
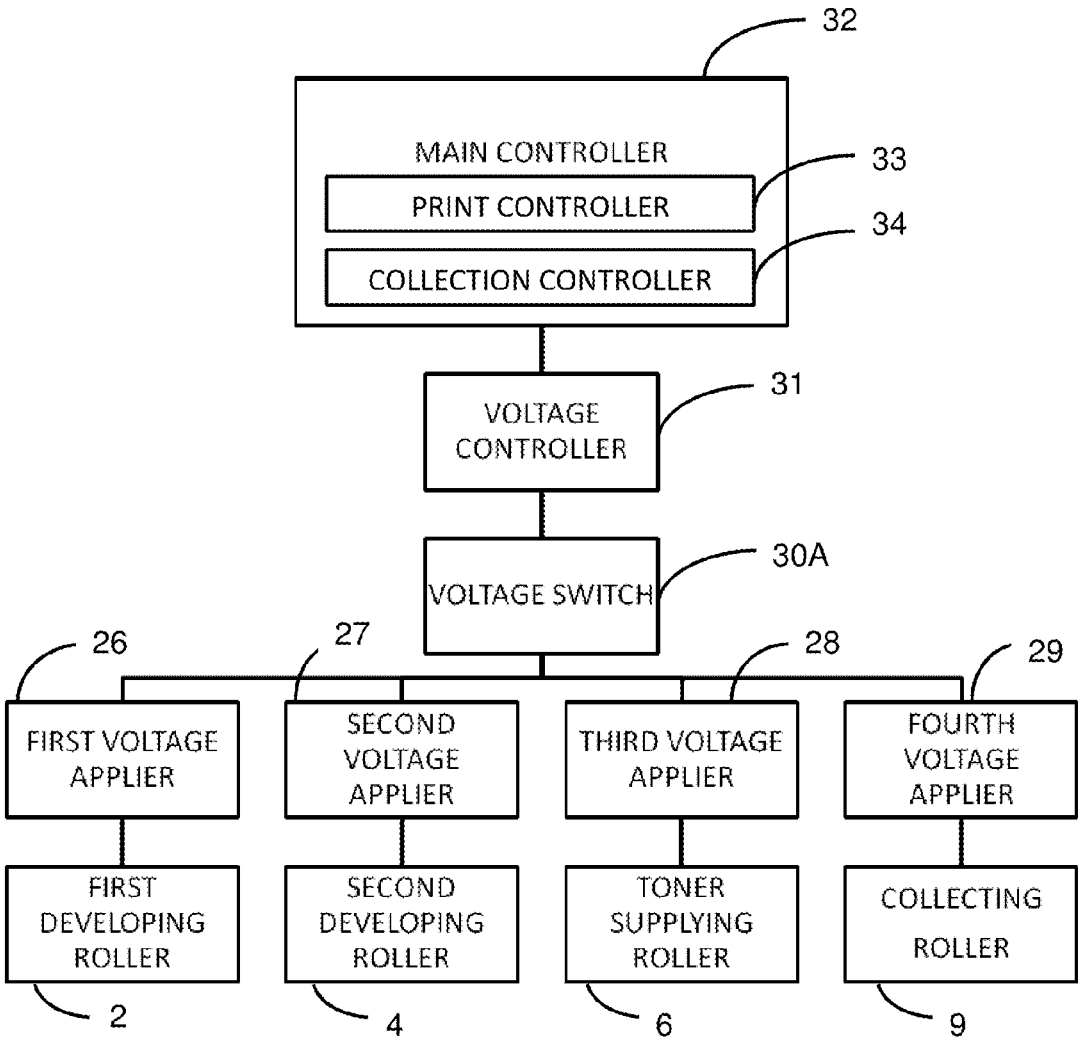
FIG. 14 is a block diagram of a controller according to a fourth embodiment.

Next, descriptions are provided for the fourth embodiment. Each developing unit 20 according to the fourth embodiment includes a collection mode in which, while developing unit 20 is performing a non-printing operation, residual toner on photosensitive drum 1 is collected. Description of the schematic configuration of printer 10 and the configuration of each developing unit 20 according to the fourth embodiment are omitted since they are the same as those of the third embodiment. FIG. 14 is a block diagram of a controller according to the fourth embodiment, which is configured to control printer 10 shown in FIG. 9. Descriptions are provided for the configuration of FIG. 14 while referring to FIG. 8.

First developing roller 2, second developing roller 4, toner supplying roller 6 and collecting roller 9 are respectively connected to first voltage applier 26, second voltage applier 27, third voltage applier 28 and fourth voltage applier 29.

First voltage applier 26 supplies a first voltage to first developing roller 2. Similarly, second voltage applier 27 supplies a second voltage to second developing roller 4. Third voltage applier 28 supplies a third voltage to toner supplying roller 6. In addition, fourth voltage applier 29 supplies a fourth voltage to collecting roller 9.

The power supply includes first voltage applier 26, second voltage applier 27, third voltage applier 28, fourth voltage applier 29 and voltage switch 30A. First voltage applier 26, second voltage applier 27, third voltage applier 28 and fourth voltage applier 29 are connected to voltage switch 30A. Voltage switch 30A is further connected to voltage controller 31. Voltage controller 31 is connected to main controller 32. Main controller 32 controls all of the other blocks. In addition, main controller 32 includes: print controller 33 configured to control an operation of printer 10 during a normal printing operation; and collection controller 34 configured to control an operation of printer 10 while the developing unit 20 is performing a non-printing operation, which is the characteristic of the fourth embodiment.

Next, descriptions are provided for operations according to the fourth embodiment. Description of the printing operation which printer 10 performs under the control of print controller 33 during the normal printing operation is omitted, since it is the same as in the third embodiment. Assume a scenario in which melamine charged to have positive polarity is externally added to toner 7 charged to have negative polarity, and resulting mixture comprises toner 7 that is used for printing. In such case, the melamine is separated away from toner 7, and attracts onto photosensitive drum 1 during the printing operation of developing unit 20. Printer 10 according to the fourth embodiment has the collection mode in which the melamine attractd onto photosensitive drum 1 is collected while developing unit 20 is performing the non-printing operation. The collection mode is set as a mode performed by developing unit 20 during the time when developing unit 20 is not performing the printing operation. For example, the collection mode may be set to be performed each time after a printing operation for the 1000 image formation is completed. Otherwise, the collection mode may be set to be performed each time after a print job is completed, or each time after a printing operation for one page is completed.

The collection mode according to the fourth embodiment is carried out as follows. During the non-printing operation of developing unit 20, light source L exposes photosensitive drum 1 with light. Concurrently, the first, second, third and fourth voltages are applied to first developing roller 2, second developing roller 4, toner supplying roller 6 and collecting roller 9, where the first, second, third and fourth voltages satisfy a relationship in which "the absolute value of the surface potential of a light-exposed area on photosensitive drum 1<the absolute value of the first voltage<the absolute value of the fourth voltage," and "the absolute value of the third voltage<the absolute value of the second voltage<the absolute value of the first voltage." In this mode the first, second, third and fourth voltages have the same polarity, which is equal to the polarity with which the toner is charged. In other words, while each developing unit 20 is performing the non-printing operation, printer 10 executes its operation by causing light source L to expose photosensitive drum 1 with light, and by causing first voltage applier 26, second voltage applier 27, third voltage applier 28 and fourth voltage applier 29 to apply the voltages to the respective rollers as described above, and by causing drivers (not illustrated) to rotate the respective rollers. The applied voltages, for example, may be such that: the surface potential of the light-exposed part of photosensitive drum 1 is −50V; and the first, second, third and fourth voltages are −300 V, −200 V, −100 V and −400 V, respectively. Consequently, the relationship described above is defined as: "the absolute value (50 V) of the surface potential of the light-exposed part of photosensitive drum 1<the absolute value (300 V) of the first voltage<the absolute value (400 V) of the fourth voltage," and "the absolute value (100 V) of the third voltage<the absolute value (200 V) of the second voltage<the absolute value (300 V) of the first voltage."

Thereby, the external additive (charged with the polarity opposite to that of the toner) separated away from toner 7 during the developing process and then adhering to photosensitive drum 1 is conveyed to collecting roller 9 via first developing roller 2 due to the potential difference produced under the control of collection controller 34. In addition, it is possible to prevent toner 7 existing on collecting roller 9 from moving to photosensitive drum 1. That is because, even if toner 7 existing on collecting roller 9 moves to first developing roller 2, toner 7 subsequently moves to second developing roller 4 and then to toner supplying roller 6.

Furthermore, in a case where the potential differences are set as described above during the non-printing operation, toner 7 is not transported from toner supplying roller 6 to second developing roller 4, and subsequently to first developing roller 2 and photosensitive drum 1. For this reason, no toner is wasted.

During the printing operation, once a color-print instruction is issued from print controller 33, voltage controller 31 controls voltage switch 30A so that the first, second, third and fourth voltages should be respectively applied to first developing roller 2, second developing roller 4, toner supplying roller 6 and collecting roller 9 where the first, second, third and fourth voltages satisfy the relationship in which "the absolute value of the first voltage<the absolute value of second voltage<the absolute value of the third value," and "the polarity of the fourth voltage is opposite to the polarities of the first, second and third voltages."

Developing unit 20 including the configuration according to the fourth embodiment and developing unit 20 including the configuration according to the third embodiment (as comparative example 6) are evaluated as follows. Conditions used for this comparative evaluation are the same as those described in the description for the third embodiment, unless otherwise specified.

First, the printing speed (=photosensitive drum linear measurement=sheet passing speed) of the apparatus is set at 150 mm/sec in the RT environment. Subsequently, A4-size Excellent White sheets as sheets P are conveyed in their lengthwise direction F, and 5000 copies of the full half-tone pattern with a print density of 25% are printed on sheets P. After the 5000 copies of the pattern are printed, a copy of a full solid (100-percent-duty) pattern is printed on an A4-size standard-type sheet. Thereafter, the obtained printed sample is evaluated in terms of whether or not the printed sample includes a defectively-printed area of a white patch. The white patch occurs on the printed image due to deposition of the external additive on photosensitive drum 1 (herein after such print defect is referred to as OPC filming). This evaluation is carried out by visibly checking the printed sample for each developing units. In a case where a printed sample includes no white patch, the result is rated as "excellent." In a case where the area of a white patch is less than 10% of the printed area although the white patch occurs in a printed sample, the result is rated as "good." In a case where the area of a white patch is not less than 10% but not more than 50% of the printed area in a printed sample, the result is rated as "poor." In a case where the area of a white patch is more than 50% of the printed area in a printed sample, the result is rated as "very poor."

The same evaluations are made under both of the HH and LL environments. FIG. 17 shows the results of the evaluations of the printed samples obtained by use of cyan toner. However, the results of the evaluations obtained by use of each of black, yellow and magenta toners show similar tendencies. FIG. 17 shows the results of the evaluations made in terms of the OPC filming.

The results of the evaluations are as follows. Developing unit 20 having the configuration according to the fourth embodiment shows an almost excellent evaluation result under all the environments. Conversely, it is observed that the printed sample produced by use of developing unit 20 according to comparative example 6 is defectively printed due to the OPC filming under the LL and RT environments. The above difference in evaluation result is due to the configuration according to the fourth embodiment which enables the external additive (charged with the polarity opposite to that of the toner) to be collected from the surface of photosensitive drum 1, whereas cleaning blade 21-1 (shown in FIG. 10) of the conventional type is incapable of fully collecting the external additive from the surface of photosensitive drum 1.

In the case where developing unit 20 according to comparative example 6 prints the 5000 copies of the 0.3-percent-duty pattern on the respective sheets, which is performed with regard to the third embodiment, developing unit 20 according of comparative example 6 is evaluated as excellent or good in terms of the OPC filming under all the environments. That is because contact between toner 7 and photosensitive drum 1 is less in the print pattern used for the third embodiment than that for the fourth embodiment, and similarly contact between the external additive and photosensitive drum 1 is less in the print pattern used for the third embodiment than that for the fourth embodiment.

As described above, it is possible to effectively remove the external additive from the surface of photosensitive drum 1 without adding any member to the configuration in the case where, during the non-printing operation of developing unit 20, light source L exposes photosensitive drum 1 with light, and concurrently the first, second, third and fourth voltages are respectively applied to first developing roller 2, second developing roller 4, toner supplying roller 6 and collecting roller 9, where the first, second, third and fourth voltages satisfy the relationship in which "the absolute value of the surface potential of the light-exposed part of the photosensitive drum<the absolute value of the first voltage<the absolute value of the fourth voltage," and "the absolute value of the third voltage<the absolute value of the second voltage<the absolute value of the first voltage (the first, second, third and fourth voltages having the same polarity, and their polarity being equal to that of the toner)." Consequently, developing unit 20 according to the fourth embodiment is capable of offering an excellent image quality free from the OPC filming even in a printing environment which tends to cause the OPC filming.

As described above, the developing apparatus according to each of the embodiments is capable of mitigating excessive electrostatic charge of the toner, the excessive electrostatic charge causing the toner to tend to move from the developing roller to the photosensitive drum. Thereby, the developing apparatus is capable of preventing a printed sheet from being smeared due to toner adhering to a non-exposed area on the photosensitive drum. Accordingly, the developing apparatus according to each embodiment is capable of preventing the image quality from deteriorating, and thus offering an excellent image quality free from sheet fog and smear.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developing unit comprising:

a developer;

an image carrier on which an electrostatic latent image is formed;

a first developer carrier configured to develop the electrostatic latent image formed on the image carrier by causing the developer to attract to the electrostatic latent image;

a first restriction member configured to be in press-contact with the first developer carrier;

a second developer carrier configured to abut to the first developer carrier, and to form a developer layer on the second developer carrier;

a second restriction member configured to abut to the second developer carrier; and a supplying member configured to supply the second developer carrier with the developer, wherein a moving direction of the first developer carrier and a moving direction of the second developer carrier are the same at a first abutment point, and the moving direction of the second developer carrier and a moving direction of the supplying member are opposite to each other at a second abutment point.

2. The developing unit of claim 1, further comprising a developer collecting member configured to abut to the first developer carrier and to collect an undeveloped portion of the developer on the first developer carrier.

3. The developing unit of claim 1, wherein the image carrier is movably supported, and forms a developer image by causing the developer to attract to the electrostatic latent image formed by exposing the image carrier to light, the first developer carrier is in contact with the image carrier in a facing manner and is movably supported, a first end of the first restriction member is in press-contact with the first developer carrier, and a second end of the first restriction member is fixed so that the first end thereof is located upstream of a contact point between the first developer carrier and the image carrier in a moving direction of the first developer carrier, the second developer carrier is movably supported, abuts to the first developer carrier at the first abutment point located upstream of a press-contact position between the first restriction member and the first developer carrier in the moving direction of the first developer carrier, a first end of the second restriction member is in press-contact with the second developer carrier, and a second end of the second restriction member is fixed so that the first end thereof is located upstream of the first abutment point of the second developer carrier and the first developer carrier in a moving direction of the second developer carrier, and the supplying member is movably supported, abuts to the second developer carrier at the second abutment point located upstream of a press-contact position between the second developer carrier and the second restriction member in the moving direction of the second developer carrier, and supplies the developer to the second developer carrier.

4. An image forming apparatus comprising:

a developing unit including a developer, an image carrier on which an electrostatic latent image is formed, a first developer carrier configured to develop the electrostatic latent image formed on the image carrier by causing the developer to attract to the electrostatic latent image, a first restriction member configured to be in press-contact with the first developer carrier, a second developer carrier configured to abut to the first developer carrier, and to form a developer layer, a second restriction member configured to abut to the second developer carrier, and a supplying member configured to supply the second developer carrier with the developer; and a power supply configured to supply voltages to the first developer carrier, the second developer carrier and the supplying member.

5. The image forming apparatus of claim 4, wherein the power supply applies a first voltage to the first developer carrier, a second voltage to the second developer carrier, and a third voltage to the supplying member.

6. The image forming apparatus of claim 5, wherein the absolute values of the first, second, and third voltages applied by the power supply satisfy a relationship where the absolute value of the first voltage < the absolute value of the second voltage < the absolute value of the third voltage.

7. The image forming apparatus of claim 4, wherein while the developing unit is in a non-printing operation, the power supply applies a first voltage to the first developer carrier, a second voltage to the second developer carrier, and a third voltage to the supplying member, and the absolute values of the respective voltages satisfy a relationship where the absolute value of the first voltage > the absolute value of the second voltage > the absolute value of the third voltage.

8. The image forming apparatus of claim 4, further comprising a developer collecting member configured to abut to the first developer carrier and to collect an undeveloped portion of the developer on the first developer carrier, wherein the power supply applies voltages to the first developer carrier, the second developer carrier, the supplying member, and the developer collecting member.

9. The image forming apparatus of claim 8, wherein the power supply applies a first voltage to the first developer carrier, a second voltage to the second developer carrier, a third voltage to the supplying member, and a fourth voltage to the developer collecting member.

10. The image forming apparatus of claim 9, wherein the absolute values of the first, second, third, and fourth voltages applied by the power supply satisfy a relationship where the absolute value of the first voltage < the absolute value of the second voltage < the absolute value of the third voltage, and the polarity of the fourth voltage is opposite to the polarities of the first, second and third voltages.

11. The image forming apparatus of claim 8, wherein while the developing unit is in a non-printing operation, the power supply applies a first voltage to the first developer carrier, a second voltage to the second developer carrier, a third voltage to the supplying member, and a fourth voltage to the developer collecting member, and the absolute values of the respective voltages satisfy a relationship where the absolute value of a surface potential of a light-exposed portion on the photosensitive drum < the absolute value of the first voltage < the absolute value of the fourth voltage, and the absolute value of the third voltage < the absolute value of the second voltage <the absolute value of the first voltage.

12. The image forming apparatus of claim 11, wherein the polarities of the first, second, third and fourth voltages are all the same, and their polarities are the same as a polarity of electrostatic charge of the developer.

13. A developing unit for developing an image by use of a developer, comprising:

a developer supplier configured to supply the developer;

a second developer conveyer configured to attract and convey the developer from the developer supplier, the second developer conveyer having a second voltage applied thereto;

a first developer conveyer configured to attract and convey the developer from the second developer conveyer, the first developer conveyer having a first voltage applied thereto, wherein an absolute value of the first voltage is less than an absolute value of the second voltage;

an image carrier having an electrostatic latent image formed thereon by exposing the image carrier to light, wherein the electrostatic latent image is developed by attracting the developer from the first developer conveyer, wherein a moving direction of the first developer conveyer and a moving direction of the second developer conveyer are the same at a first abutment point, and the moving direction of the second developer conveyer and a moving direction of the developer supplier are opposite to each other at a second abutment point.

14. The developing unit of claim 13, further comprising a first layer thickness restricting member configured to restrict a first thickness of a first layer comprised of the developer conveyed by the first developer conveyer, the first layer thickness restricting member being located upstream of a facing position between the first developer conveyer and the image carrier in a rotational direction of the first developer conveyer.

15. The developing unit of claim 14, wherein a predetermined voltage is applied to the first layer thickness restricting member.

16. The developing unit of claim 13, wherein a predetermined voltage is applied to at least one of the first developer conveyer and the second developer conveyer.

17. A developing unit for developing an image by use of a developer, comprising:

a developer supplier configured to supply the developer;

a second developer conveyer configured to attract and convey the developer from the developer supplier, the second developer conveyer having a second voltage applied thereto;

a first developer conveyer configured to attract and convey the developer from the second developer conveyer, the first developer conveyer having a first voltage applied thereto, wherein an absolute value of the first voltage is less than an absolute value of the second voltage;

an image carrier having an electrostatic latent image formed thereon by exposing the image carrier to light, wherein the electrostatic latent image is developed by attracting the developer from the first developer conveyer;

a second layer thickness restricting member configured to restrict a second thickness of a second layer comprised of the developer conveyed by the second developer conveyer, the second layer thickness restricting member being located downstream of a facing position between the second developer conveyer and the first developer conveyer in a rotational direction of the second developer conveyer.

18. The developing unit of claim 17, wherein a first layer thickness restricting member is located between the facing position between the first developer conveyer and the second developer conveyer, and a facing position between the first developer conveyer and the image carrier.

* * * * *